US010674776B2

(12) United States Patent
Matich

(10) Patent No.: US 10,674,776 B2
(45) **Date of Patent: *Jun. 9, 2020**

(54) FACE MASK WITH SEAL WITHIN SEAL AND OPTIONAL BRIDGING SEAL

(71) Applicant: Ronald D. Matich, Baxter, MN (US)

(72) Inventor: Ronald D. Matich, Baxter, MN (US)

(73) Assignee: Breathe Safely, Inc., Baxter, MN (US)

( * ) Notice: Subject to any disclaimer, the term of this patent is extended or adjusted under 35 U.S.C. 154(b) by 1066 days.

This patent is subject to a terminal disclaimer.

(21) Appl. No.: 13/754,875

(22) Filed: Jan. 30, 2013

(65) Prior Publication Data

US 2013/0180529 A1 Jul. 18, 2013

Related U.S. Application Data

(63) Continuation of application No. 12/577,174, filed on Oct. 10, 2009, now Pat. No. 8,381,727.
(Continued)

(51) Int. Cl.
*A41D 13/11* (2006.01)
*A62B 18/02* (2006.01)
(Continued)

(52) U.S. Cl.
CPC ..... *A41D 13/1176* (2013.01); *A41D 13/11* (2013.01); *A41D 13/1138* (2013.01);
(Continued)

(58) Field of Classification Search
CPC .. A61M 16/00; A61M 16/06; A61M 16/0683; A61M 16/0688; A61M 16/0694;
(Continued)

(56) References Cited

U.S. PATENT DOCUMENTS 4,729,371 A 3/1988 Krueger et al.
4,807,619 A 2/1989 Dyrud et al.
(Continued)

FOREIGN PATENT DOCUMENTS

JP 2005013492 A 1/2005
JP 2007215877 A 8/2007
WO 9925410 A1 5/1999

OTHER PUBLICATIONS

International Society for Respiratory Protection, Sixteenth International Conference, schedule of conference, Sep. 23-27, 2012, six pages, International Society for Respiratory Protection, Mona Vale, Australia.

(Continued)

*Primary Examiner* — Colin W Stuart

(57) ABSTRACT

The present face mask may have a double seal, a triple seal or a quadruple seal, with distinct spacing between each of the seals within a set of seals. Each of the seals within a double seal, triple seal, or quadruple seal may stand alone or may be interconnected to other seals by bridging, where such bridging is formed of the same adhesive as the seal itself. Also disclosed is an after market embodiment where a multiple seal by itself is housed between two sheets of release paper to be applied to a face mask by the user himself when needed. Further disclosed is a multiple seal with bridging applied to a clothing combination, such as to seal sleeve cuffs to a glove.

1 Claim, 10 Drawing Sheets

Related U.S. Application Data

(60) Provisional application No. 61/241,861, filed on Sep. 11, 2009.

(51) Int. Cl.
*A62B 18/00* (2006.01)
*A62B 23/02* (2006.01)
*A62B 23/00* (2006.01)

(52) U.S. Cl.
CPC ..... *A41D 13/1161* (2013.01); *A41D 13/1169* (2013.01); *A62B 18/00* (2013.01); *A62B 18/02* (2013.01); *A62B 18/025* (2013.01); *A62B 23/00* (2013.01); *A62B 23/02* (2013.01); *A62B 23/025* (2013.01)

(58) Field of Classification Search
CPC ..... A62B 17/006; A62B 18/00; A62B 18/02; A62B 18/08; A62B 23/00; A62B 23/02; A62B 23/025; A62B 23/06; A41D 13/11; A41D 13/1107; A41D 13/1161; A41D 13/1169; A41D 13/1176
See application file for complete search history.

(56) References Cited

U.S. PATENT DOCUMENTS

| | | | | |
|---|---|---|---|---|
| 4,850,347 | A | 7/1989 | Skov | |
| 5,307,796 | A | 5/1994 | Kronzer et al. | |
| 5,374,458 | A | 12/1994 | Burgio | |
| 5,676,133 | A | 10/1997 | Hickle et al. | |
| 6,119,692 | A | 9/2000 | Byram | |
| 6,196,223 | B1 | 3/2001 | Belfer et al. | |
| 6,341,606 | B1 | 1/2002 | Bordewick et al. | |
| 6,420,455 | B1 | 7/2002 | Landgrebe et al. | |
| 6,705,317 | B2 | 3/2004 | Castiglione | |
| 6,783,574 | B1 | 8/2004 | Angadjivand et al. | |
| 6,827,764 | B2 | 12/2004 | Springett et al. | |
| 6,849,329 | B2 | 2/2005 | Perez et al. | |
| 6,948,499 | B2 | 9/2005 | Griesbach et al. | |
| 7,017,577 | B2 | 3/2006 | Matich | |
| 7,131,442 | B1 | 11/2006 | Kronzer et al. | |
| 7,309,513 | B2 | 12/2007 | Brey et al. | |
| 7,390,351 | B2 | 6/2008 | Leir et al. | |
| 7,503,326 | B2 | 3/2009 | Martin | |
| 7,524,176 | B2 | 4/2009 | Yao | |
| 7,594,510 | B2 | 9/2009 | Betz et al. | |
| 8,381,727 | B2 * | 2/2013 | Matich | 128/206.14 |
| 2002/0023651 | A1 | 2/2002 | Japuntich et al. | |
| 2002/0046754 | A1 | 4/2002 | Baumann et al. | |
| 2002/0088466 | A1 | 7/2002 | Brostrom et al. | |
| 2003/0005934 | A1 | 1/2003 | Japuntich et al. | |
| 2003/0136410 | A1 | 7/2003 | Matich | |
| 2003/0192546 | A1 | 10/2003 | Bostock et al. | |
| 2004/0011362 | A1 | 1/2004 | Angadjivand et al. | |
| 2004/0019952 | A1 | 2/2004 | Brockman | |
| 2004/0089304 | A1 | 5/2004 | Barakat et al. | |
| 2004/0231023 | A1 | 11/2004 | Huang | |
| 2004/0255947 | A1 | 12/2004 | Martin et al. | |
| 2005/0139216 | A1 | 6/2005 | Mittelstadt et al. | |
| 2006/0180152 | A1 | 8/2006 | Bostock et al. | |
| 2007/0050883 | A1 | 3/2007 | Matich | |
| 2007/0119459 | A1 | 5/2007 | Japuntich et al. | |
| 2007/0235031 | A1 | 10/2007 | Betz | |
| 2008/0023006 | A1 | 1/2008 | Kalatoor | |
| 2008/0099022 | A1 | 5/2008 | Gebrewold et al. | |
| 2008/0110469 | A1 | 5/2008 | Weinberg | |
| 2008/0134418 | A1 | 6/2008 | Johansson et al. | |
| 2008/0315454 | A1 | 12/2008 | Angadjivand et al. | |
| 2008/0318014 | A1 | 12/2008 | Angadjivand et al. | |
| 2009/0000624 | A1 | 1/2009 | Lee et al. | |
| 2009/0078261 | A1 | 3/2009 | Martin et al. | |
| 2009/0078262 | A1 | 3/2009 | Gebrewold et al. | |
| 2009/0078264 | A1 | 3/2009 | Martin et al. | |
| 2009/0078265 | A1 | 3/2009 | Gebrewold et al. | |
| 2009/0078266 | A1 | 3/2009 | Stepan et al. | |
| 2009/0090364 | A1 | 4/2009 | Daugaard et al. | |
| 2009/0133700 | A1 | 5/2009 | Martin et al. | |
| 2009/0211581 | A1 | 8/2009 | Bansal | |
| 2009/0211582 | A1 | 8/2009 | Reese et al. | |
| 2009/0235934 | A1 | 9/2009 | Martin | |

OTHER PUBLICATIONS

Rengasamy et al., Nanoparticle Penetration Through Filter Media and Through Face Seal Leakage of N95 Filtering Facepiece Respirators, power point presentation, Sep. 25, 2012, International Society for Respiratory Protection, Boston, MA, USA.

Grinshpun et al., Performance of an N95 Filtering Facepiece Particulate Respirator and a Surgical Mask During Human Breathing: Two Pathways for Particle Penetration, Journal of Occupational and Environmental Hygiene, Oct. 2009, 6: 593-603, Philadelphia, PA, USA.

* cited by examiner

FACE MASK WITH SEAL WITHIN SEAL AND OPTIONAL BRIDGING SEAL

CROSS REFERENCE TO RELATED APPLICATIONS

This application is a continuation of U.S. patent application Ser. No. 12/577,174 filed Oct. 10, 2009, which application was a nonprovisional application of U.S. provisional application No. 61/241,861 filed Sep. 11, 2009. This application claims the benefit under 35 U.S.C. 120 of U.S. patent application Ser. No. 12/577,174 filed Oct. 10, 2009, which application claimed the benefit under 35 U.S.C. 119(e) of U.S. provisional application No. 61/241,861 filed Sep. 11, 2009. U.S. patent application Ser. No. 12/577,174 filed Oct. 10, 2009 and U.S. Provisional Patent Application No. 61/241,861 filed Sep. 11, 2009 are hereby incorporated by reference in their entireties into this application.

FIELD OF THE INVENTION

The present invention relates to a face mask, particularly to a face mask having a seal about its periphery, and specifically to a face mask with an outer seal and an inner seal and an optional bridging seal connecting the outer and inner seals.

BACKGROUND OF THE INVENTION

Golf courses undulate. That is, even relatively easy and relatively flat golf courses have ups and downs, peaks and valleys, sand dunes, raised tee off areas, and raised greens. Further, even if a fairway happens to be like a pancake, the fairway may dogleg to the left or dogleg to the right to provide an undulation from another perspective.

Each and every golf course is a unique piece of property. The unique features of a golf course are many. A few of these unique features are natural features found prior to development such as lakes, ponds and streams. Other unique features are manmade: the layout, the total yardage, the width of the fairways, and the size of the greens.

Faces, like golf courses, are unique and undulating. The application to a face of a face mask having a single seal is like a game of golf with no Mulligans, but infinitely more serious.

SUMMARY OF THE INVENTION

A feature of the present invention is the provision in a face mask having a covering for the nostrils and mouth, with the covering having a periphery, with the covering having an inside confronting the face, and with the covering having an exterior opposing the inside and facing away from the face, of a first endless skin adhesive seal on the inside of the covering, and of a second endless skin adhesive seal on the inside of the covering, with the second endless skin adhesive seal spaced from the first endless skin adhesive seal, and with the second endless skin adhesive seal confronting the first endless adhesive seal.

Another feature of the present invention is the provision in such a face mask, of at least one of said first and second endless skin adhesive seals comprising a bead, with the bead having an at least partially generally curved form such that the bead digs into the face.

Another feature of the present invention is the provision in such a face mask, of at least one of said first and second endless skin adhesive seals comprising a bead, with the bead having a cross-section, with the cross-section having a circumference, with a portion of the circumference engaging the inside of the covering, with another portion of the circumference extending obliquely relative to the portion of the circumference engaging the inside of the covering such that the bead digs into the face.

Another feature of the present invention is the provision in such a face mask, of a connection between the first and second endless skin adhesive seals, with the connection being formed of the same material of the first and second endless skin adhesive seals.

Another feature of the present invention is the provision in such a face mask, of a connection between the first and second endless skin adhesive seals, with the connection being integral and one-piece with at least one of the first and second endless skin adhesive seals.

Another feature of the present invention is the provision in such a face mask, of a third endless skin adhesive seal on the inside of the covering, with the third endless skin adhesive seal spaced from the second endless skin adhesive seal, with the third endless skin adhesive seal confronting the second endless skin adhesive seal, and with the second endless skin adhesive seal being between the first and third endless skin adhesive seals.

Another feature of the present invention is the provision in such a face mask, of a fourth endless skin adhesive seal on the inside of the covering, with the fourth endless skin adhesive seal spaced from the third endless skin adhesive seal, with the fourth endless skin adhesive seal confronting the third endless skin adhesive seal, and with the third endless skin adhesive seal being between the second and fourth endless skin adhesive seals.

Another feature of the present invention is the provision in such a face mask, of the first endless adhesive seal confronting the periphery of the covering.

Another feature of the present invention is the provision in such a face mask, of the face mask being disposed in generally a plane prior to the face mask being applied to the face.

Another feature of the present invention is the provision in such a face mask, of the multiple seal being disposed in a plane prior to application to the face mask.

Another feature of the present invention is the provision in a ready to apply seal apparatus having a front sheet of release paper and a rear sheet of release paper, of a first endless skin adhesive seal sandwiched between the front and rear sheets of release paper, and a second endless skin adhesive seal sandwiched between the front and rear sheets of release paper, with the second endless skin adhesive seal spaced from the first endless skin adhesive seal, with the second endless skin adhesive seal confronting the first endless adhesive seal, and with the second endless skin adhesive seal being disposed inwardly of the first endless adhesive seal.

Another feature of the present invention is the provision in such a ready to apply seal apparatus, of the combination of the apparatus with a face mask, with the face mask comprising a covering for the nostrils and mouth, with the covering having a periphery, with the covering having an inside confronting the face, and with the covering having an exterior opposing the inside and facing away from the face, with the first and second endless skin adhesive seals to be applied to the inside of the covering where the first endless skin adhesive seal confronts the periphery of the covering.

Another feature of the present invention is the provision in a face mask or respirator, of a multiple seal arrangement disposed between the face mask and the skin of the face, where at least two of the seals are endless seals and where these at least two endless seals are independent of each other, like the independent suspension of an automobile, where the chances are minimized that a force applied to one of the endless seals is transferred or translated to the other seal, such that each of the endless seals works independently of the other endless seal.

Another feature of the present invention is the provision in a face mask or respirator, of a seal having a pair of endless protrusions extending from an adhesive endless base or strip, where the base or connection between the endless protrusions is engaged to the face mask and where the endless protrusions engage the skin of the face.

An advantage of the present invention is that the present face mask is greatly more effective than a face mask having a single seal.

Another advantage of the present invention is that the present face mask may fit, with great effectiveness, the face of an adult or the face of a child.

Another advantage of the present invention is that the present face mask is greatly more effective than a face mask having a single relatively wide seal.

Another advantage of the present invention is that the present face mask is inexpensive to manufacture.

DETAILED DESCRIPTION

Figure 1A:
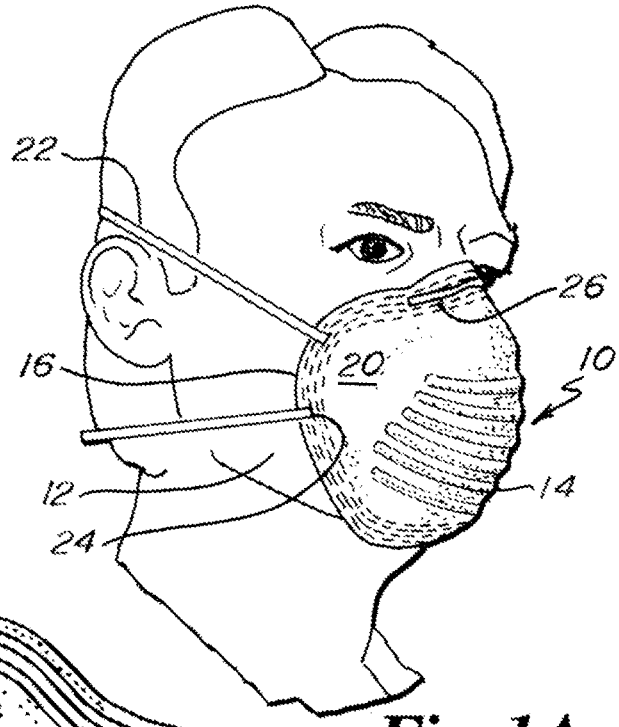
FIG. 1A is an environmental view showing the face mask of the present invention on a face.
Figure 1B:
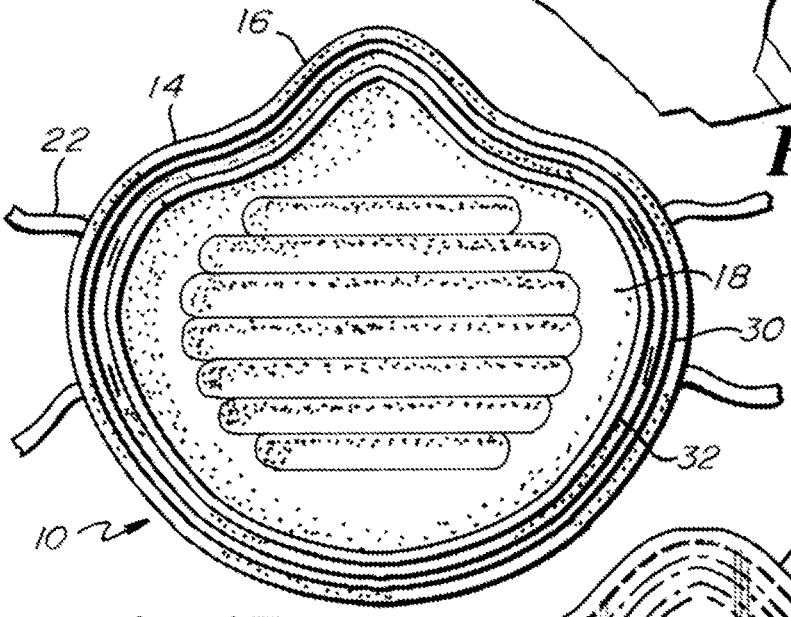
FIG. 1B shows the mask of FIG. 1A, where the mask includes a double seal with no bridges.

FIG. 1 shows a cup shaped or receptacle shaped face mask 10 on a face 12 of a person. Face mask 10 includes a covering or filter 14 for the nostrils and mouth. The covering 14 has a periphery 16, an inside or inside face 18 (shown in FIG. 1B) confronting the face 12, and an exterior or outside or exterior face 20 opposing the inside 18 and facing away from the face 12. Exterior face 20 is convex. Inside face 18 is concave. In other words, the covering 14 includes an exterior portion 20 projecting outwardly of the mouth, with the portion 20 projecting outwardly of the mouth being within the periphery 16 and being convex relative to the exterior 20 of the covering 14.

A harness or a pair of rubber or elastomeric bands 22 engages a peripheral portion of the mask 10. One band 22 engages and draws to the face 12 an upper portion of the mask 10. The other band 22 engages and draws to the face 12 a lower portion of the mask 10. Each of the ends of the bands 22 is engaged to the mask 10 via a staple 24 that extends from the exterior 20 to the inside 18.

Mask 10 further includes a bridge strip 26 of bendable material, preferably metal, that engages the outside 20 of the mask 10. Bendable material is little, if at all, resilient. Once bent, material of the bridge strip 26 stays bent. The qualities of the material of bridge strip 26 for a springing back or rebounding to the shape it had prior to being bent are minimized Bridge strip 26 is malleable. The qualities of the material of bridge strip 26 for retaining its shape after being bent are maximized. Bridge strip 26 is pliable. When bridge strip 26 is bent over the nose, bridge strip 26 stays in such uniquely bent shape. As shown in FIG. 6B, opposing the bridge strip 26, on the inside 18 of the mask 10 is a foam strip or resilient strip or cushion 28 of material to soften the application of the bridge strip 26 across the nose. Cushion 28 is engaged to the inside 18 of the mask 10.

The periphery 16 of the covering 14 completely surrounds the nostrils and mouth. The periphery 14 is structured to extend from a first position on the bridge of the nose above the nostrils to the right side of the nose, from said right side of the nose to a position on the front of the face beyond the right side of the mouth, from said position beyond the right side of the mouth to one of a first position on the chin and a second position under the chin, from one of said first and second positions to a position on the front of the face beyond the left side of the mouth, from said position beyond the left side of the mouth to the left side of the nose, from said left side of the nose back to said first position on the bridge of the nose such that the nostrils and mouth are completely surrounded.

As shown in FIG. 1B, mask 10 includes a first endless skin adhesive seal 30 on the inside 18 of the covering 14 and a second endless skin adhesive seal 32 on the inside 18 of the covering 14. Second seal 32 is disposed inwardly of first seal 30. Second seal 32 has a lesser diameter than first seal 30. Second seal 32 tracks the outline or shape or contour of first seal 30. Second seal 32 runs parallel to first seal 30. The second endless skin adhesive seal 32 is spaced from the first endless skin adhesive seal 30. The second endless skin adhesive seal 32 confronts the first endless adhesive seal 30. The first endless adhesive seal 30 confronts the periphery 16 of the covering 14. As also shown in FIG. 1B, the first endless skin adhesive seal 30 confronts the periphery 16 of the covering 14, and the first endless skin adhesive seal 30 is between the periphery 16 of the covering 14 and the second endless skin adhesive seal 32.

Figure 5A:
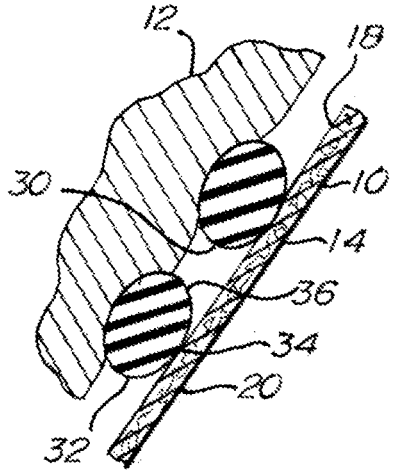
FIG. 5A is a diagrammatic view of the seal of FIG. 1B affixed to a face, showing how each of the beads of the double seal digs into the face.

As shown in FIG. 5A, at least one, and preferably both of, first and second endless skin adhesive seals 30, 32 is formed of a bead of adhesive, with the bead having an at least partially generally curved form so as to dig into the skin of the face. The cross section of the bead may form a circle, an ellipse, an oval shape or some other at least partially curved shape. In other words, at least one of, and preferably both of, first and second endless skin adhesive seals 30, 32 includes a bead, where the bead includes a cross-section, where the cross-section includes a circumference, with a portion 34 of the circumference engaging the inside 18 of the covering 14, with another portion 36 of the circumference extending obliquely relative to the portion of the circumference engaging the inside of the covering.

As shown in FIGS. 2C, 3A, 4A, and 4B, an alternate embodiment of the mask 10, designated mask 10A, includes a connection or bridge 38 that extends between the first and second endless skin adhesive seals 30, 32. The connection 38 is formed of the same adhesive material of the first and second endless skin adhesive seals 30, 32. The connection or bridge 38 between the first and second endless skin adhesive seals 30, 32 is integral and one-piece with at least one of the first and second endless skin adhesive seals 30, 32 and is preferably integral and one-piece with each of the first and second seals 20, 32.

Figure 2A:
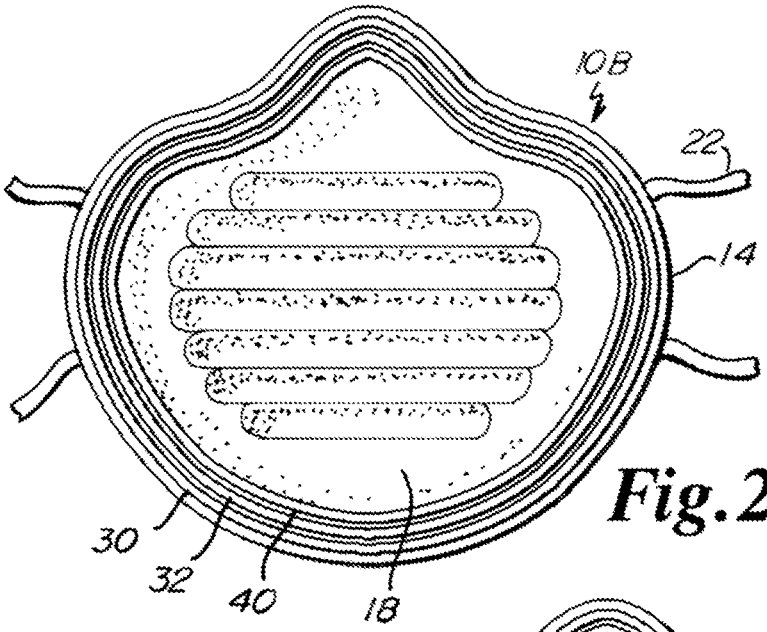
FIG. 2A shows a mask of the present invention, where the mask includes a triple seal with no bridges.

As shown in FIG. 2A, an alternate embodiment of the mask 10, designated mask 10B, includes a third endless skin adhesive seal 40 on the inside 18 of the covering 14, with the third endless skin adhesive seal 40 spaced from the second endless skin adhesive seal 32, with the third endless skin adhesive seal 40 confronting the second endless skin adhesive seal 32, and with the second endless skin adhesive seal 32 being between the first and third endless skin adhesive seals 30, 40. The third seal 40 is inwardly of the second seal 32. The third seal 40 has a lesser diameter than each of the first and second seals 30, 32. Third seal 40 tracks the outline or shape or contour of first and second seals 30, 32. Third seal 40 runs parallel to first and second seals 30, 32.

Figure 2B:
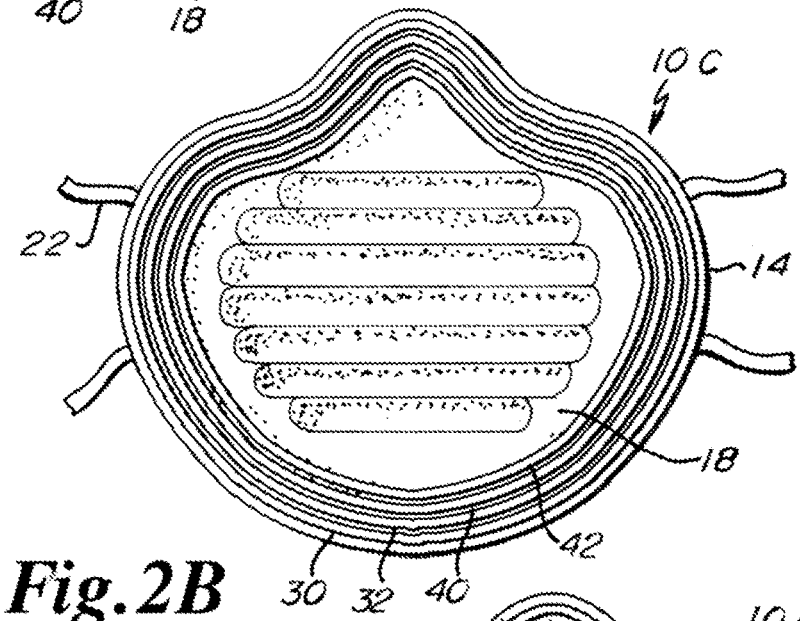
FIG. 2B shows a mask of the present invention, where the mask includes a set of four seals with no bridges.

As shown in FIG. 2B, an alternate embodiment of the mask 10, designated mask 10C, includes a fourth endless skin adhesive seal 42 on the inside 18 of the covering 14, with the fourth endless skin adhesive seal 42 spaced from the third endless skin adhesive seal 40, with the fourth endless skin adhesive seal 42 confronting the third endless skin adhesive seal 40, and with the third endless skin adhesive seal 40 being between the second and fourth endless skin adhesive seals 32, 42. The fourth seal 42 is inwardly of the third seal 40. The fourth seal 42 has a lesser diameter than each of the first, second, and third seals 30, 32 and 40. Fourth seal 42 tracks the outline or shape or contour of first, second and third seals 30, 32 and 40. Fourth seal 42 runs parallel to first, second and third seals 30, 32 and 40.

Figure 4A:
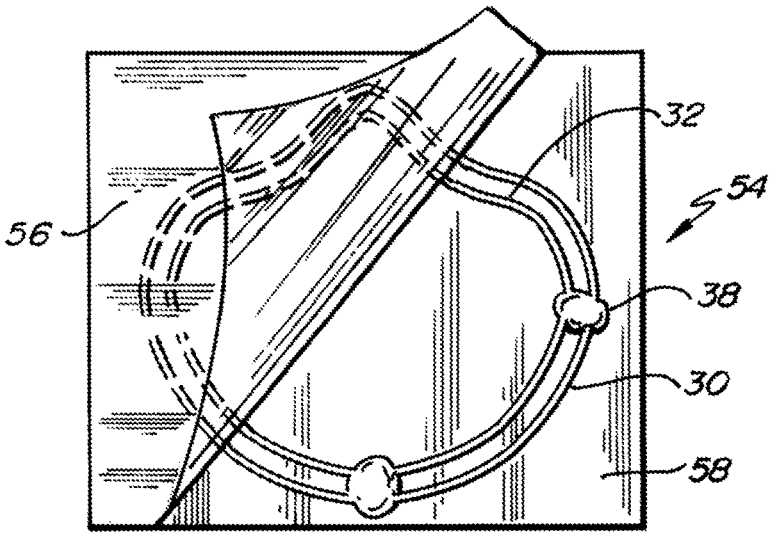
FIG. 4A shows a ready to apply seal apparatus that includes a double seal standing alone between two release sheets with relatively thick bridges, where the ready to apply seal apparatus is intended for application to a face mask having no seal.
Figure 4B:
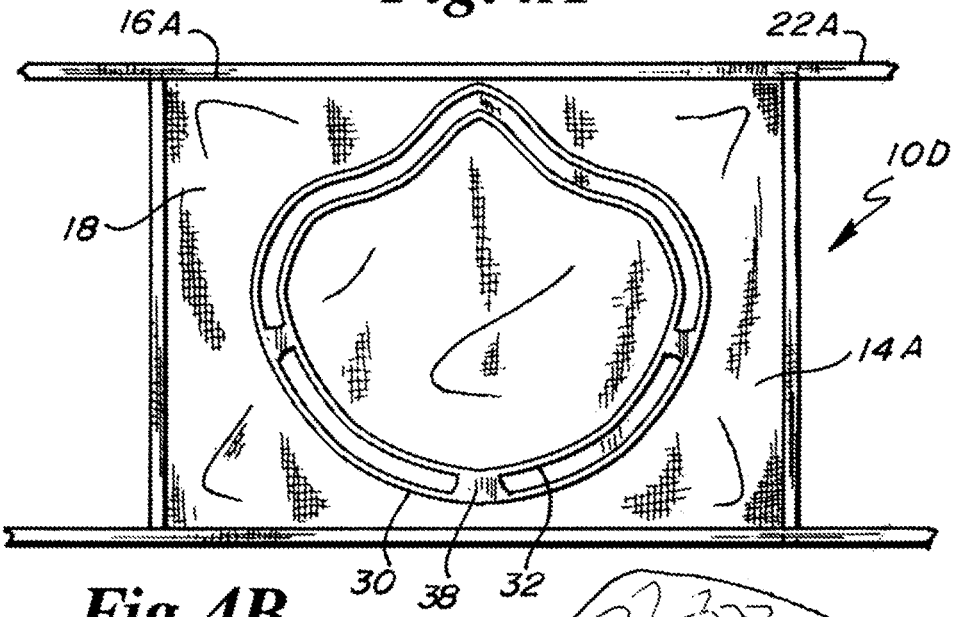
FIG. 4B shows a surgical mask having a seal of the present invention, where the seal is a double seal with bridges.

As shown in FIG. 4B, an alternate embodiment of the mask 10, designated 10D, is disposed in generally a plane prior to being applied to the face 12. Mask 10D is rectangular in shape and includes one pair of two opposing parallel edges and another pair of opposing parallel edges. Mask 10D may be referred to as a surgical mask. Mask 10D may include bands 22A that are rubber or elastomeric in the nature of bands 22 of mask 10. Bands 22A, where such engage the rectangular periphery 16A of mask 10D, are parallel. Mask 10D includes a covering 14A having the qualities of covering 14. Outer and inner seals 30, 32 are engaged to the inside 18 of mask 10D, with three connections or bridges 38 engaged between the seals 30, 32.

Covering or filter 14 and covering or filter 14A are structured to permit air into and out of the coverings 14 and 14A. Coverings 14 and 14A are structured to minimize a flow of substances into and out of the coverings 14 and 14A.

Figure 1C:
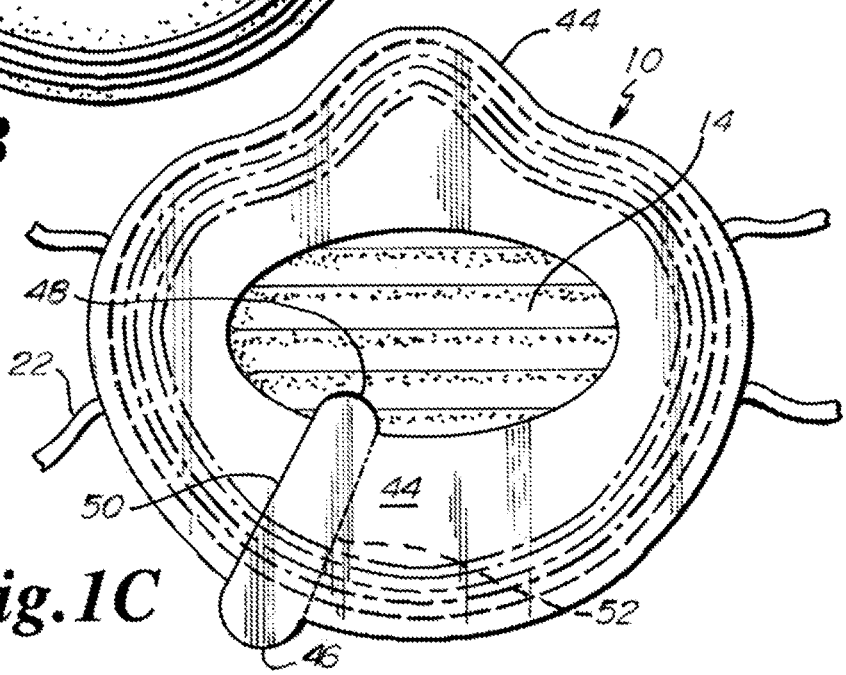
FIG. 1C shows the mask of FIG. 1B with the double seal with no bridges and a liner over the double seal, with the liner having a pair of thumb tabs for removal.

As shown in FIG. 1C, a release paper 44 is disposed over and lightly engaged to the first and second endless skin adhesive seals 30, 32. Such a release paper 44 can also be disposed over and lightly engaged to the set of seals 30, 32 and 40 and the set of seals 30, 32, 40 and 42, where such sets of seals may or may not include connections or bridges 38. Face mask 10 comprises a concave inside portion 18. The first and second endless skin adhesive seals 30, 32 engage and track the concave inside portion 18. The release paper 44 is formed in a frustoconical shape so as to include a convex portion to track and cover the first and second endless skin adhesive seals 30, 32. Frustoconical release paper 44 includes an outer tab 46 extending from an outer diameter or outer edge of the circular release paper 44 and an inner tab 48 extending from an inner diameter or inner edge of the release paper 44. The frustoconical release paper 44 may be formed in an endless configuration where one end of the release paper 44 is one-piece and integral with the other end of the release paper 44, or the release paper 44 may have two distinct ends that may or may not overlap and tabs 46 and 48 may be located near such ends. Where overlapping ends are present, one end is designated by reference number 50 and the other end is designated by reference number 52.

FIG. 4A shows a ready to apply seal apparatus 54 that includes a front sheet 56 of release paper, a rear sheet 58 of release paper, the first endless skin adhesive seal 30 sandwiched between the front and rear sheets 56, 58 of release paper, and the second endless skin adhesive seal 32 sandwiched between the front and rear sheets 56, 58 of release paper, with the second endless skin adhesive seal 32 spaced from the first endless skin adhesive seal 30, with the second endless skin adhesive seal 32 confronting the first endless adhesive seal 30, and with the second endless skin adhesive seal 32 being disposed inwardly of the first endless adhesive seal 30. The ready to apply seal apparatus 54 is intended for use in combination with a face mask such as face mask 10, 10A, 10B, 10C, 10D. The first and second endless skin adhesive seals 30, 32 are applied to and engage the inside 18 of the covering 14. With mask 10, the first seal 30 confronts and tracks the periphery 16. With mask 10D, the first seal 30 confronts at least a portion of the periphery 16A of the mask 10D. To apply a seal configuration sandwiched between sheets 56, 58, one of the sheets 56, 58 is removed, then the exposed seal configuration is set into or onto the inside or inner face of a mask, then the user can run his or her fingers over the outside face of the release sheet 56, 58 that remains so as to press on the seal configuration through the release sheet 56, 58 that remains engaged to the seal configuration so as to press the seal configuration with a good amount of pressure into the covering 14, and then the remaining release sheet 56, 58 is lifted off the seal configuration.

Figure 2C:
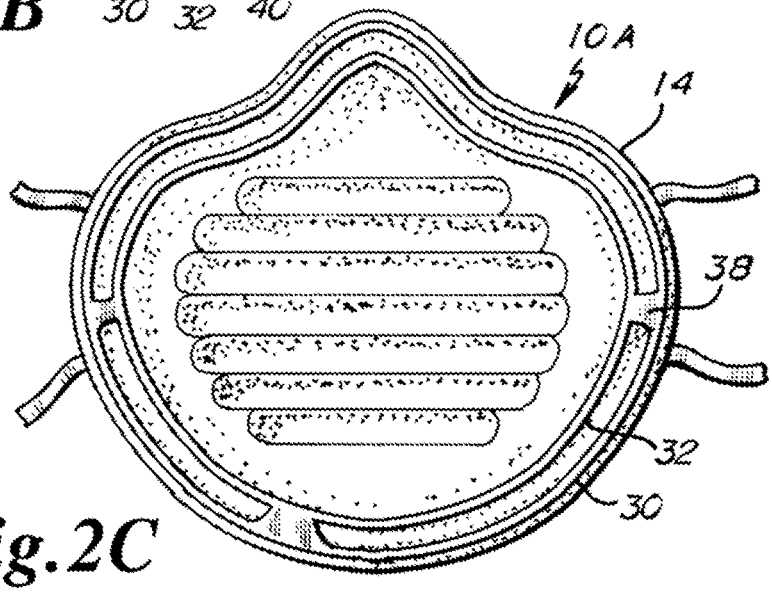
FIG. 2C shows a mask of the present invention, where the mask includes a double seal with bridges.
Figure 3A:
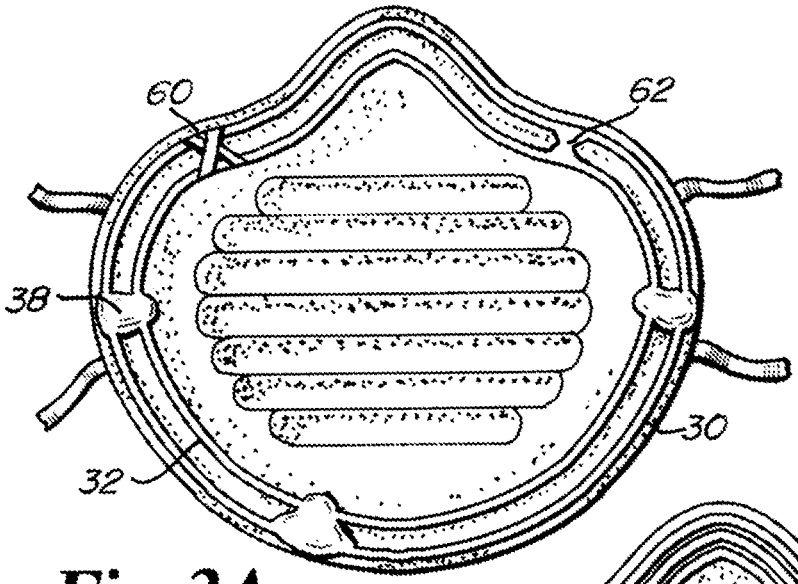
FIG. 3A shows a mask of the present invention, where the mask includes a double seal with relatively thick bridges.
Figure 3B:
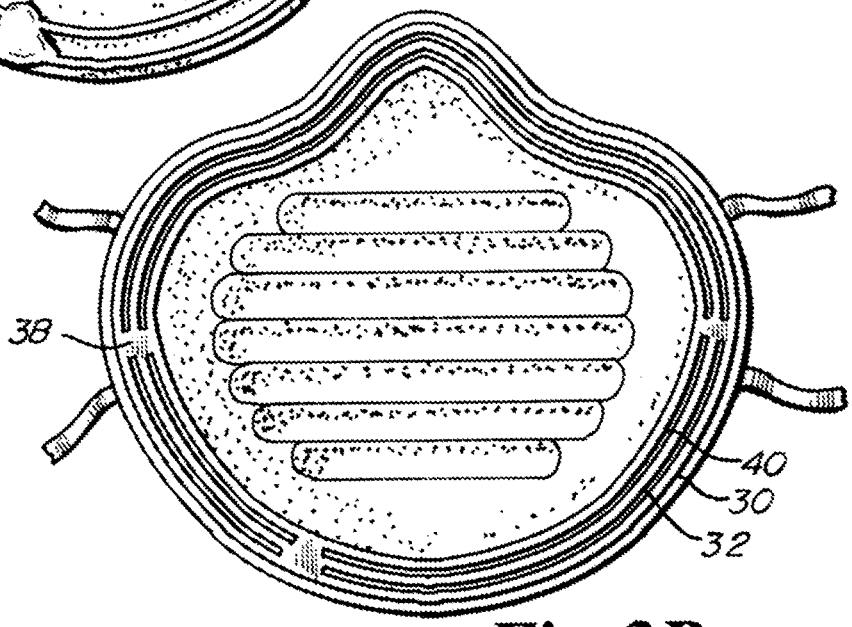
FIG. 3B shows a mask of the present invention, where the mask includes a triple seal with bridges.
Figure 3C:
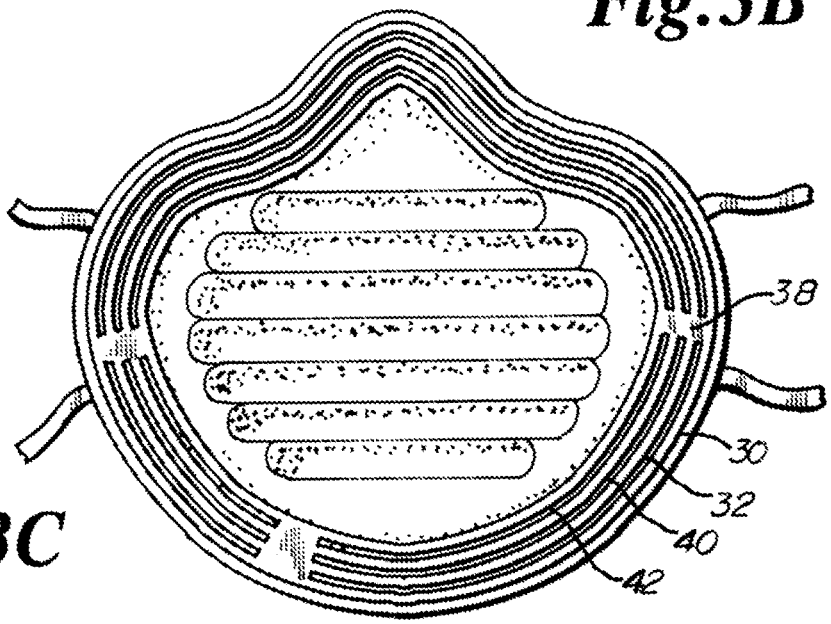
FIG. 3C shows a mask of the present invention, where the mask includes a set of four seals with bridges.

FIG. 2C shows a double seal configuration where the connections or bridges 38 have a thickness that is the same as the thickness of seals 30, 32. FIG. 3A shows a double seal configuration having connections or bridges 38 that are greater in thickness than seals 30, 32. FIG. 3B shows a triple seal configuration where bridges 38 have a thickness that is the same as the thickness of seals 30, 32, and 40. FIG. 3C shows a quadruple seal configuration where bridges 38 have a thickness that is the same as the thickness of seals 30, 32, 40 and 42.

FIG. 3A shows a first X bridge 60 and a second X bridge 62. Bridges 60, 62 are formed of the same type of adhesive as seals 30, 32, like bridges 38. Bridge 60 is formed by two strips of adhesive engaging each other and also engaging each of the seals 30, 32. Bridge 62 shows the two strips of bridge 60 in a compressed form.

FIG. 3A shows that relatively thick connections 38 having portions extending exteriorly of seal 30 and interiorly of seal 32. Connections 38 of FIGS. 2C, 3B, 3C and 4B have are contained between the outer and inner seals.

It should be noted that the set of seals chosen for apparatus 54 may have connections 38 that are contained between the outer and inner seals. In other words, each of the sealing configurations shown in FIGS. 1B, 2A, 2B, 2C, 3A, 3B, 3C, 4A and 4B may be engaged in the apparatus 54.

As to a process for making the seal configurations of the present invention, the endless seals 30, 32, 40 and 42 and the connections 38 may be formed from a pressure sensitive hot melt adhesive and applied in a manufacturing facility. The adhesive may be applied in a fluid viscous form from an apparatus such as a tube or hot glue gun. Then the adhesive is permitted to cool and set to a rubber or rubber like state. Then the release paper or liner 44 is applied over the pressure sensitive hot melt adhesive. Then the face mask 10 is packaged for sale.

The skin adhesive seals may be skin friendly adhesive seals or skin unfriendly adhesive seals. As to skin friendly and skin unfriendly adhesive seals and other seals and adhesives, the Matich U.S. Pat. No. 7,017,577 B2 is hereby incorporated by reference in its entirety.

The adhesive or seal or bead used herein, such as the double, triple, or quadruple seal arrangement or configuration with or without bridges used herein, may include a styrene-olefin-styrene block copolymer.

One adhesive for the multiple seal arrangement of the present invention that may be used is a pressure sensitive hot melt adhesive available from The Glue Factory, An Ellsworth Adhesives Company, of Appleton, Wis. Such adhesive may be used for the double seal with or without bridges, the triple seal with or without bridges and the quadruple seal with or without bridges.

As to the adhesive for the double, triple, or quadruple seal arrangements with or without bridges used herein, the following U.S. Patents are incorporated by reference in their entireties: 1) the Fujisawa et al. U.S. Pat. No. 6,262,330 issued Jul. 17, 2001, 2) the Kitazaki et al. U.S. Pat. No. 6,297,421 issued Oct. 2, 2001, 3) the Takahashi et al. U.S. Pat. No. 6,323,275 issued Nov. 27, 2001, 4) the Hechenberger et al. U.S. Pat. No. 4,997,861 issued Mar. 5, 1991, 5) the Hickey et al. U.S. Pat. No. 6,310,166 issued Oct. 30, 2001, 6) the Satterfield U.S. Pat. No. 6,179,804 issued Jan. 30, 2001, 7) the Poulsen et al. U.S. Pat. No. 4,367,732 issued Jan. 11, 1983, and 8) the Matich U.S. Pat. No. 7,017,577 B2.

Figure 4C:
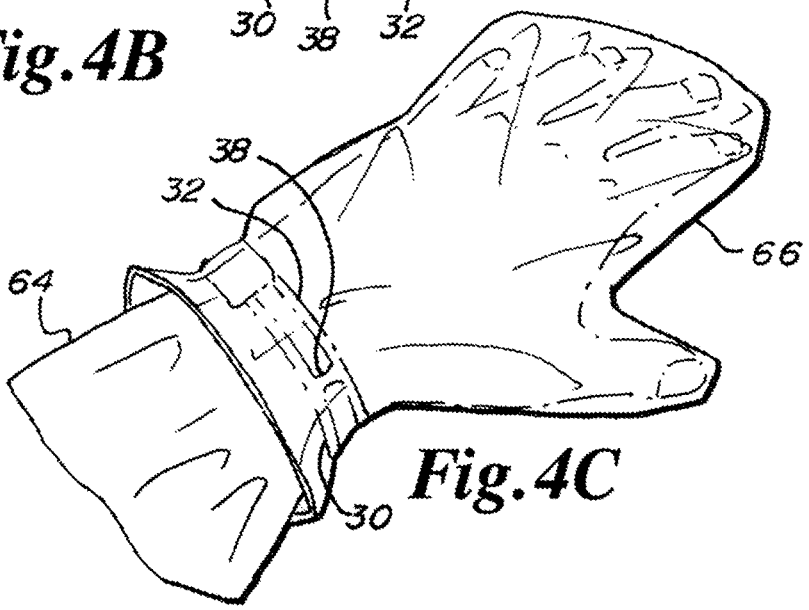
FIG. 4C shows a seal of the present invention, where the seal is a double seal with bridges, where the seal has been applied between a sleeve and a mitten.

FIG. 4C shows that a double, triple or quadruple seal configuration may be used between two articles of clothing, such as a shirt 64 and a mitten 66. Other clothing article combinations includes a shirt/hood, a pants leg/shoe, a pants/leg sock, a jacket/hood, shirt/pants, and jacket/pants. Reference number 64 can designate any article of clothing having an opening through which a body part extends. Reference number 66 can designate any article of clothing having an opening through which a body part extends and which is intended to confront clothing article 64.

FIG. 5A shows that bead adhesive seals 30, 32 provide a greater surface area of adhesion to the skin than flat adhesive strips. The curved beads 30, 32 dig into the skin.

As shown in FIG. 5A, covering 14 includes a covering portion running to and between the first and second endless skin adhesive seals 30, 32. As shown in FIG. 5A, an entirety of the covering portion of covering 14 is adjacent to each of the first and second endless skin adhesive seals 30, 32. As shown in FIG. 5A, the covering portion of covering 14 runs directly from the first endless skin adhesive seal 30 to the second endless skin adhesive seal 32. As shown in FIG. 5A, in a section view, the covering portion, the first endless skin adhesive seal 30, the second endless skin adhesive seal 32, and the face 12 define a four sided closed space. As shown in FIG. 5A, the entirety of the covering portion of covering 14 is adjacent to the face 12. As shown in FIG. 5A, the entirety of the covering portion of covering 14 runs generally parallel to the face 12.

Figure 6A:
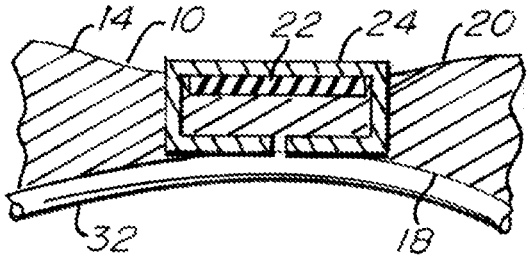
FIG. 6A shows a diagrammatic view of a staple fixing an end of a band to the mask, and with the inner seal of the present invention covering the inside of the staple and sealing punctures caused by the staple.
Figure 6B:
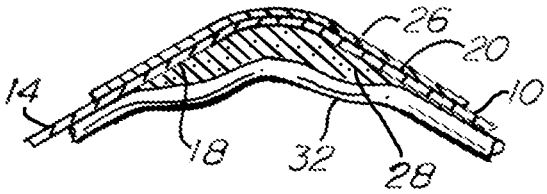
FIG. 6B shows a diagrammatic view of a metallic bridge strip malleable to the nose and being on the outside of a mask, of a cushion opposite of the malleable strip and being on the inside of a mask, and of the inner seal engaging the cushion and compressing ends of the cushion to the inside of the mask.

FIG. 6A shows that inner seal 32 can confront and close off punctures caused by staples 24. FIG. 6B shows that inner seal 32 can close off any openings caused by cushion 28 where the ends of the cushion 28 meet the inside 18 of the face mask 10.

Connections or bridges 38 have the advantage of making the seal configurations easier to separate from the release paper 44.

The seal configurations, i.e., one or more of the endless seals 30, 32, 40, 42 and connections 38, may be applied in a hot or cold form to the mask 10 itself and in a hot or cold form to apparatus 54.

The seal configurations provide a uniform fit. That is, a seal configuration with at least one inner seal maximizes the chances that such a seal configuration will fit each of an adult and child's face because, with the multiple seal arrangement, the innermost endless seal or bead has a first relatively small diameter, the subsequent endless seal or bead has a second diameter greater than the first diameter, the subsequent endless seal or bead has a third diameter greater than the second diameter, and the subsequent endless seal or bead has a fourth diameter greater than the third diameter.

The provision of at least one inner seal 32 provides a tortuous path for entry of toxic substances. That is, a toxic substance must confront and find its way through the outer seal 30 and then, if successful, wind its way about the space between the outer and inner seal until it finds an opening in an inner seal 32. The provision of a connection or bridge 38 even further guards against the entry of a toxic substance by blocking such a tortuous path that the toxic substance must take.

The provision of an inner seal 32 provides protection for a maximum number of unique undulating faces. One portion of the outer seal 30 may not perfectly fit a portion of a face. One portion of the inner seal 32 may not perfectly fit a portion of a face. However, in combination, especially with bridges 38, a tortuous path to a maximum degree is provided.

Seals 30, 32, 40 and 42 may not run parallel to each other. In fact, it may be beneficial to provide nonparallel seals 30, 32, 40 and 42.

A face mask or respirator, such as face mask 10, includes a periphery, such as periphery 16, where the face mask filter or covering, such as filter or covering 20 terminates, and where the skin is exposed. The outermost seal of the multiple seal arrangement here, such as the double seal with or without bridges, such as the triple seal with or without bridges, such as the quadruple seal with or without bridges, is preferably placed as close to the absolute periphery as possible without going beyond the periphery. Peripheries of face mask often include flat areas and the beads of adhesive may be placed upon such flat areas.

The peripheral portion of a face mask or respirator may be described as the part of the filter or covering that runs from an absolute periphery to an inner portion spaced from the absolute periphery. This peripheral portion may have elevation differences, or structural differences, or uneven or undulating surfaces, or material or composition differences. These differences may be found as one runs his or her finger endlessly around the peripheral portion. These differences may be found as one runs his or finger radially or in a direction transverse to the endless direction. A multiple seal arrangement of the present invention, where at least two endless beads are independent of each other, or where at least two endless beads are independent of each other except for a few bridges or connections interconnecting the endless beads, maximizes the chances of at least one of the endless beads making a 360 degree connection with the skin of the face. The provision of bridges or connections close off areas where one of the endless seals has not made a 360 degree connection with the skin of the face. Also, it should be noted that the undulating, or the other differences pointed out above, of the peripheral portion of the face mask is compounded by the unique face of an individual, even if the face mask manufacturer has shaped its mask for the shape of a face.

Where connections or bridges 38 are utilized, there may number anywhere from one to about six bridges. There are competing considerations. On the one hand, it may be beneficial to block, one or more times, the tortuous path referred to above. On the other hand, it may be beneficial to keep as much of the seal configuration digging into the skin of the face 12 as possible and, where a great number of connections 38 are present, the amount of digging by distinct beads is reduced.

The location of the bridges 38 are preferably at about the three o'clock, six o'clock and nine o'clock positions. The bridges 38 can be placed equidistant apart if desired. The bridges 38 are preferably placed about the lower half of the mask 10 since this portion of the mask 10 encounters a relatively great amount of movement or flexing because of the opening and closing of the mouth of the user.

Figure 5B:
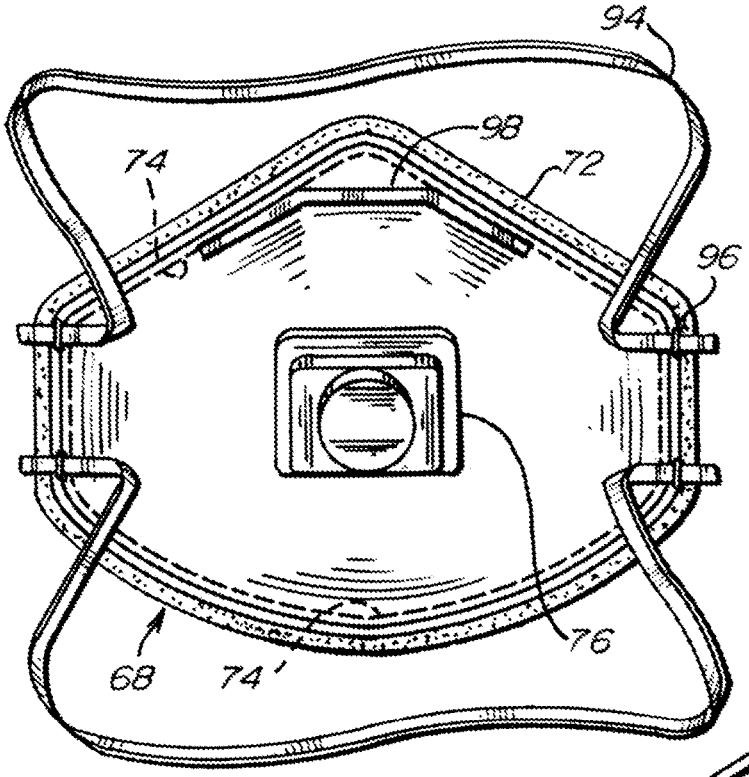
FIG. 5B is a front view of an outside of a face mask having a one-way valve, with a seal of the present invention being engaged to the inside of the face mask, where the seal is a double seal with bridges.
Figure 5C:
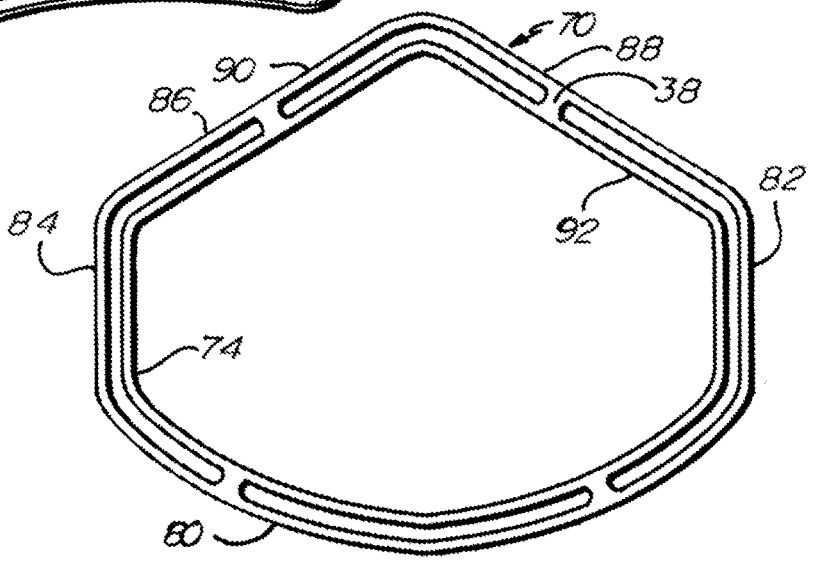
FIG. 5C is a stand alone front view of the double seal with bridges that is engaged to the inside of the face mask of FIG. 5B.

FIG. 5B shows a front view of the outside of a face mask 68, and FIG. 5C shows a double seal 70 for the inside of face mask 68. Double seal 70 is located on the inside of the face mask 68 between the endless circumference 72 of face mask 68 and an endless dashed line or location 74 spaced equidistance from the endless circumference 72. Reference number 74 also designates the inner diameter of double seal 70, which inner diameter follows dashed line 74. Face mask 68 includes a one-way valve 76. One-way valve 76 opens when a user exhales but closes when a user inhales, or prior to inhalation. In other words, when a positive pressure exists on the inside of the mask 68, one-way valve 76 treats such as an exhalation and opens. When the positive pressure such as exhalation ceases to exist, such that there is a neutral pressure, one-way valve 76 closes. One-way valve 76 remains closed when a negative pressure exists, such as upon inhalation. One-way valve 76 is biased toward the closed position. One-way valve 76 is normally closed. The circumference 72, and the double seal 70, are generally shaped in the nature of a polygon, and are specifically shaped in the nature of a pentagon such that double seal 70 includes a first, curved, arched, bottom portion 80, a pair of first and second, opposite, parallel, rectilinear side portions 82, 84, and a pair of fourth and fifth, upper rectilinear portions 86, 88. Double seal 70 includes an outer endless adhesive bead 90 and an inner endless adhesive bead 92. Outer bead 90 is spaced from inner bead 92 and runs parallel to inner bead 92. Outer bead 90 is joined to inner bead 92 by integral adhesive bridges or connections 38. Face mask 68 further includes a pair of resilient bands 94 engaged via staples 96 to perimeter portions of the face mask 68. Staples 96 may penetrate from the outer surface of the mask 68 to the inner surface of the mask 68. Any penetration of toxins, however, is resolved by inner bead 92, which is disposed inwardly of the staple 96. Face mask 68 further includes a bendable metal strip 98 to bend about the bridge of the nose. Once strip 98 is bent, strip 98 stays in the bent position.

Figure 7A:
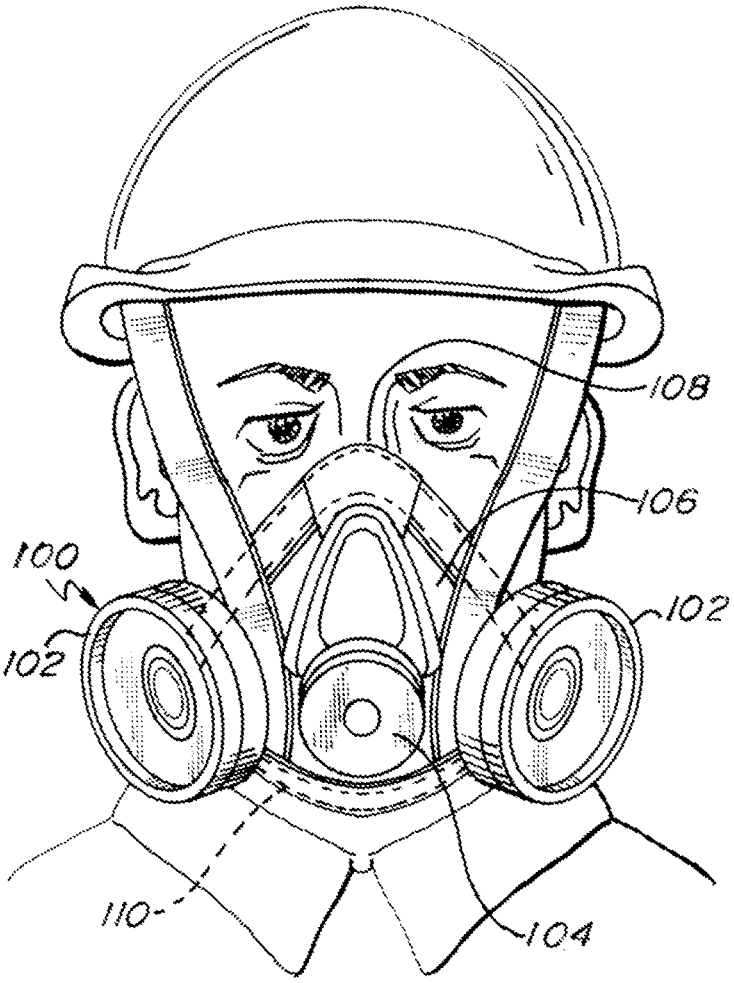
FIG. 7A shows a front view of a rubber or plastic canister respirator mask for a one-half mask, where the mask employs a double seal with bridges.

FIG. 7A shows an active face mask or respirator or gas mask 100. Mask 100 has a pair of one way valves 102 for air intake. Another valve 104 is one way for the exhalation of air. Mask 100 further includes a covering 106 having a rubber or elastomeric periphery 108 for being pressed against a face. The rubber or elastomeric periphery 108 may have the seal 110 of the present invention. The seal 110 is shown in phantom in FIG. 7A and is further shown in stand alone form in FIG. 7B. A positive air pressure exists within active face mask 100 of about three to four pounds. The conventional purpose of the positive pressure is to guard against the flow of smoke or other fluid or substance into the mask, whether such an inward flow would be about the periphery 108 or through a leak somewhere in the mask. With the seal of the present invention, air (such as in a tank on the back of the user) is conserved. That is, less air is lost flowing out of the mask 100 via the periphery 108. However, there is still a positive pressure within the mask 100 to force air through any leaks in the sealed periphery 108 or any leaks elsewhere.

Figure 7B:
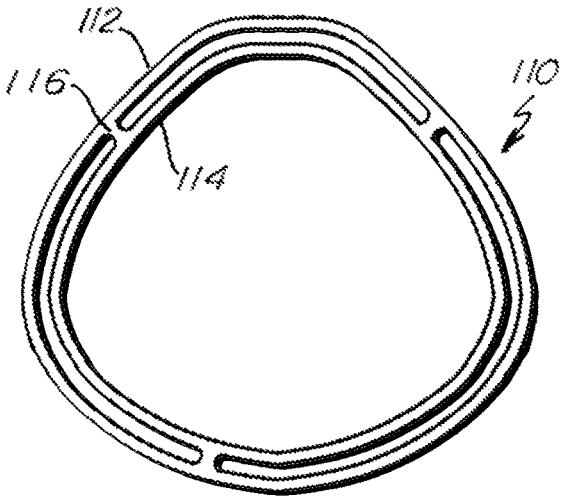
FIG. 7B shows a stand alone front view of the double seal with bridges that is engaged to the inside of the face mask of FIG. 7A.

As shown in FIG. 7B, seal 110 is a double seal having an outer adhesive bead 112, an inner adhesive bead 114 and bridges 116 of adhesive between the outer and inner beads 112, 114. Inner bead 114 is spaced from and runs parallel to outer bead 112. Double seal 110 is formed generally in the shape of a triangle, where the corners of the triangle are curved. Double seal 110 may be stored in a form shown in FIG. 4A, i.e., be sandwiched between two sheets of release paper 56, 58.

Figure 8A:
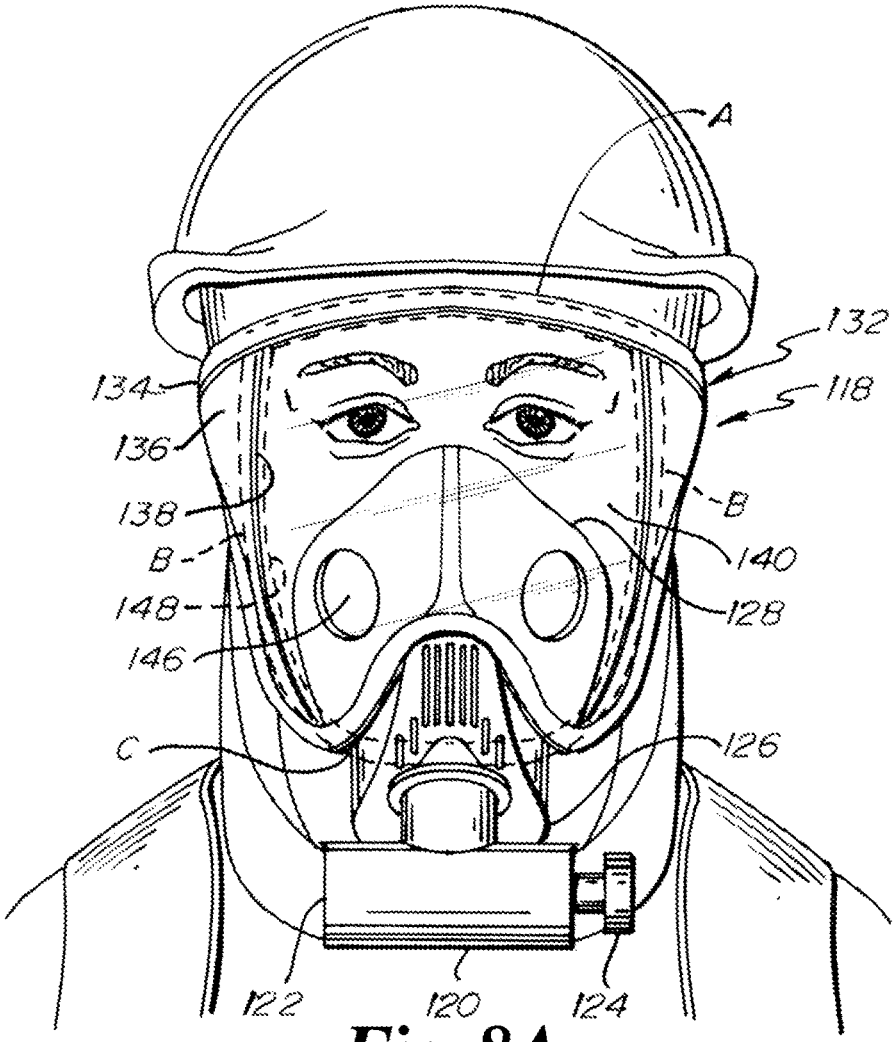
FIG. 8A shows a full face rubber or plastic positive pressure respirator mask, where the mask employs a double seal with bridges.

FIG. 8A shows an active face mask or respirator or gas mask 118. Active face mask 118 includes an air intake T-connection 120 having an air intake coupler end 122 and an air intake valve 124. The T-connection 120 is engaged to an air exhaust piece 126 and is further engaged to a nose and mouth piece 128 that confronts the mouth and nose. The combination of the air exhaust piece 126 and nose and mouth piece 128 is a base unit that includes a valve arrangement that permits fresh air into the nose and mouth piece 128 via the T-connection 120 and permits exhaled air out of the nose and mouth piece 128 and out of the mask 118 via the air exhaust piece 126. A face shield 132 is engaged to the base unit of the air exhaust piece 126 and nose and mouth piece 128 via a base hard plastic strip 134. The relatively rigid base strip 134 runs about the periphery of the face shield 132. The base strip 134 forms the shape of an inverted U between the nose and mouth piece 128 and the air exhaust piece 126. The base strip 134 runs upwardly from the inverted U shape to be disposed along the each of the sides of the face to a position near the ears so as to form a W shape. Then the base strip 134 runs inwardly from the ears and across the forehead. A clear plastic shield 140 is engaged to the outer face of the base strip 134. The face shield 132 further includes a rubber or elastomeric piece 136 (a resilient piece 136) that is engaged to the inner face of the base strip 134 except for the inverted U-shaped portion of the base strip 134, where the resilient piece 136 is engaged to an underside of the unit having the exhaust 126 and the mouth and nose piece 128 and where the resilient piece 136 cradles the chin. The resilient piece 136 thereby extends completely about the eyes, mouth and nose as a whole. The resilient piece 136 is relatively wide at the sides of the face. The resilient piece 136 includes an eye, nose and mouth opening defined by an inner edge 138 that completely surrounds the eyes, nose and mouth. The air exhaust piece 126 is generally external to the clear plastic shield 140 and the nose and mouth piece 128 is internal to the clear plastic shield 140. The nose and mouth piece 128 includes vents 146 from which air flows to the inner face of the clear plastic shield 140 to minimize formation of a condensate or fog on the inner face of the clear plastic shield 140. The seal 148 of the present invention is engaged to the active face mask 118 between the face and the resilient piece 136 as shown in phantom lines in FIG. 8A and is shown in stand alone form in FIG. 8B. The seal 148 is engaged at a position A (between the face and the portion of the resilient piece 136 that is engaged under a portion of the base strip 134 that runs across at least a part of the forehead), at two positions B (between the face and the inner edge 138 of each of the right side and left side portions of the resilient piece 136), and at a position C (between the face and the portion of the resilient piece 136 that cradles the chin). The seal 148 runs continuously from position A to position B to position C to position B to position A to run continuously about the eyes, nose and mouth as a whole. As with the active face mask of FIG. 7A, face mask 118 of FIG. 8A permits air to be conserved by the user (such as a fireman or diver). Conventionally, air is slowly lost about portions of the strip 134 and resilient piece 136 because of the positive air pressure of about three or four pounds inside of the mask 118. Conventionally, this loss of air is intended to guard against an inflow of smoke or other fluid. With the seal 148 of FIG. 8A and FIG. 8B, the positive air pressure is maintained to guard against inflow yet less fresh air from a tank is required, thereby providing the fireman or firewoman more time inside a smoke filled environment.

Figure 8B:
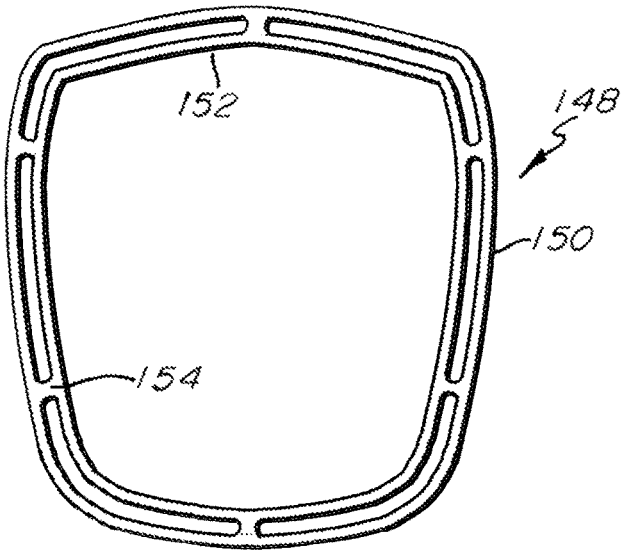
FIG. 8B shows a stand alone front view of the double seal with bridges that is engaged to the inside of the face mask of FIG. 8A.

As shown in FIG. 8B, seal 148 is a double seal having an outer adhesive bead 150, an inner adhesive bead 152 and bridges 154 of adhesive between the outer and inner beads 150, 152. Inner bead 152 is spaced from and runs parallel to outer bead 150. Double seal 148 may be stored in a form shown in FIG. 4A, i.e., be sandwiched between two sheets of release paper 56, 58. Double seal 148 includes four sides, with each of the four sides having the shape of a slight outwardly extending arch, and with each of the four corners being outwardly curved.

Figure 9B:
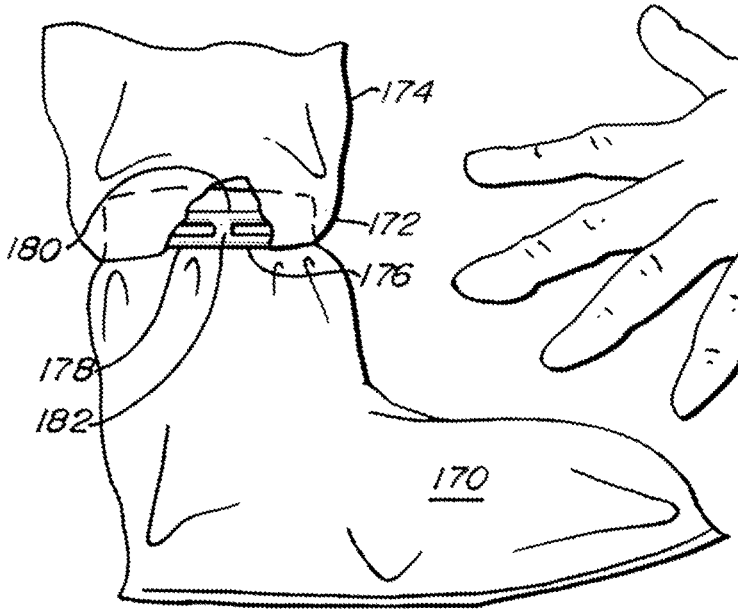
FIG. 9B shows a double seal with bridges sandwiched between the outside of a piece of footwear and the inside of the bottom of a pants leg.
Figure 9A:
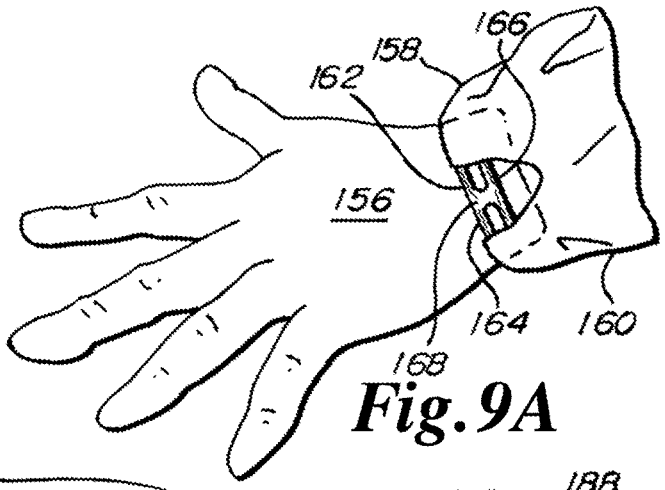
FIG. 9A shows a double seal with bridges sandwiched between the outside of a glove and the inside of a cuff of a sleeve.

FIG. 9A shows a hand covering 156, namely a glove, engaged to the end 158 of a sleeve 160 via a double seal 162 of the present invention. The glove 156 lays against the skin, the adhesive double seal 162 lays on top of the exterior of the glove 156 about the wrist portion of the glove 156, and the inner surface of the end 158 of the sleeve 160 lays on top of the double seal 162. The double seal 162 includes an outer adhesive bead 164 running parallel to and being spaced from an inner adhesive bead 166. At least one integral bridge 168 interconnects the outer and inner beads 164, 166. Hand covering 156 may alternatively be a mitten.

FIG. 9B shows a foot covering 170, namely a bootie, engaged to the end 172 of a pant's leg 174 via a double seal 176 of the present invention. The foot covering 170 lays against the skin, the adhesive double seal 176 lays on top of the exterior of the foot covering 170 about the upper ankle portion of the foot covering 170, and the inner surface of the end 172 of the pant's leg 174 lays on top of the double seal 176. The double seal 176 includes an outer adhesive bead 178 running parallel to and being spaced from an inner adhesive bead 180. At least one integral bridge 182 interconnects the outer and inner beads 178, 180. Hand covering 170 may alternatively be a mitten.

Figure 9C:
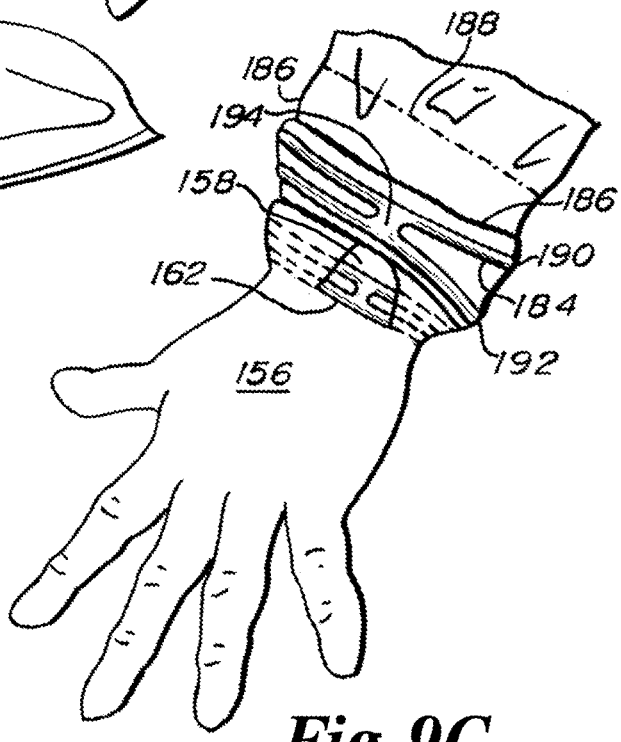
FIG. 9C shows two double seals with bridges, where a glove is sandwiched between two sleeve ends, where one seal is disposed between the outside of the inner sleeve end and the inside of the glove, and where the other seal is disposed between the outside of the glove and the inside of the outer sleeve end.

FIG. 9C shows the end 158 of the sleeve 160 against the skin, then the double seal 162 over the end 158, then the interior of the glove 156 on the inner double seal 162, then a second, outer double seal 184 on the outside of the glove 156, then the inside of a second sleeve end or cuff 186 on the seal 184. Second cuff or sleeve end 186 is shown in FIG. 9C to be inside out. Second cuff or sleeve end 186 is engaged to sleeve 160 via stitching 188. Stitching may be located so as to confront the wrist, the elbow or the shoulder. Double seal 184 includes an outer bead 190 running parallel to and being spaced from an inner bead 192. Outer and inner beads 190, 192 are interconnected by at least one bridge 194. Second cuff or sleeve end 186 is turned over (turned outside in) from the position shown in FIG. 9C to place the seals 162, 184 in operation, where sleeve end 158 lies against the skin, where seal 162 lies on sleeve end 158, where glove 156 lies on seal 162, where seal 184 lies on glove 156, and where cuff 186 lies on seal 184. Instead of being a garment with a double cuff, the ends of the sleeves in this arrangement can be from different garments, where one cuff or sleeve end is a cuff or sleeve end of a shirt and where one cuff or sleeve end is a cuff or sleeve end of a jacket. Another way to describe this arrangement is that the glove is tucked between the two cuffs or two sleeve end, with one seal being on the outer side of the inner cuff or sleeve end and with the other seal being on the inner side of the outer cuff or outer sleeve end.

Figure 9D:
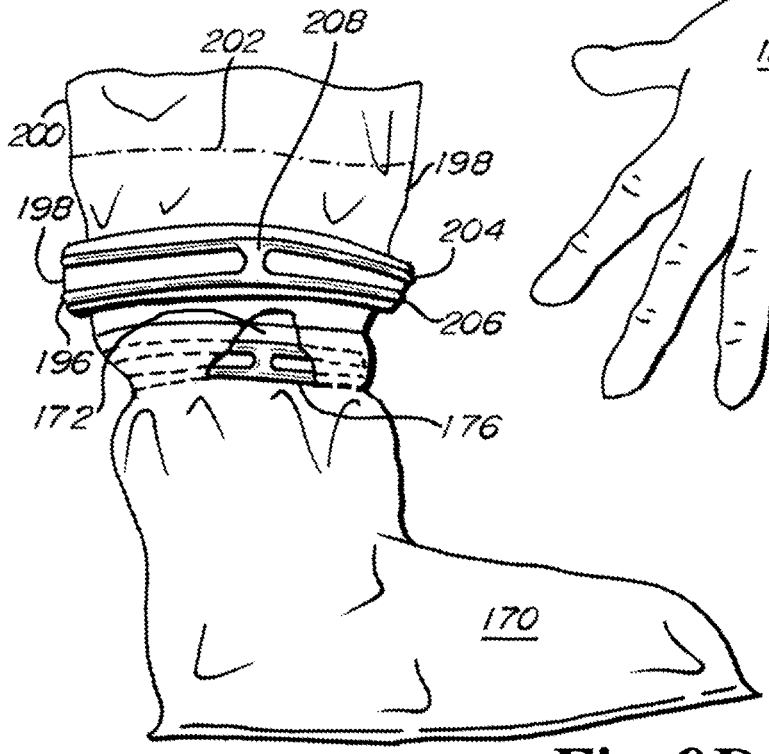
FIG. 9D shows two double seals with bridges, where a bootie or footwear covering is sandwiched between two pant ends, where one seal is disposed between the outside of the inner pant end and the inside of the bootie or foot covering, and where the other seal is disposed between the outside of the bootie or foot covering and the inside of the outer pant end.

FIG. 9D shows a foot covering 170 tucked between two cuffs or pant ends of pant garments, with one seal being on the outer side of the inner pant cuff or pant end and with the other seal being on the inner side of the outer pant cuff or outer pant end. In other words, pant end 172 lies against the skin, first inner seal 176 lies on the pant end 172, the inner side of foot covering 170 lies on first inner seal 176, the second outer seal 196 lies on the outer side of foot covering 170, and second outer pant end 198 lies on the second outer seal 196. Second cuff or pant end 198 is shown in FIG. 9D to be inside out. Second cuff or pant end 198 is engaged to pant's leg 160 via stitching 202. Stitching may be located so as to confront the ankle, knee or groin such that the second cuff or pant end 198 may be relatively short or relatively long such as in the nature of a second pant's leg. Double seal 196 includes an outer bead 204 running parallel to and being spaced from an inner bead 206. Outer and inner beads 204, 206 are interconnected by at least one bridge 208. Second cuff or pant end 198 is turned over (turned outside in) from the position shown in FIG. 9D to place the seals 176, 196 in operation. Instead of having one pant garment having a pair of inner and outer cuffs or inner and outer pant ends, the two cuffs or two pant ends here may be found on separate pant garments. For example, one pant end may be from a long underwear garment and the other pant end may be from a pair of pants.

FIGS. 1A, 1B, 1C, 2A, 2B, 2C, 3A, 3B, 3C, 5B, and 5C, show disposable masks. FIGS. 7A and 8A show nondisposable masks. As described above, FIGS. 7A and 8A show active face masks. FIG. 1A shows a passive face mask.

Figure 10A:
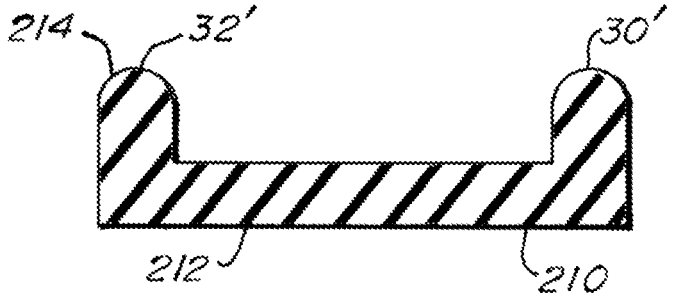
FIG. 10A shows a section view of another embodiment of the multiple seal arrangement where the bridge or connection between the multiple seals is a strip or base of adhesive, where the multiple seal is an endless double seal.
Figure 10B:
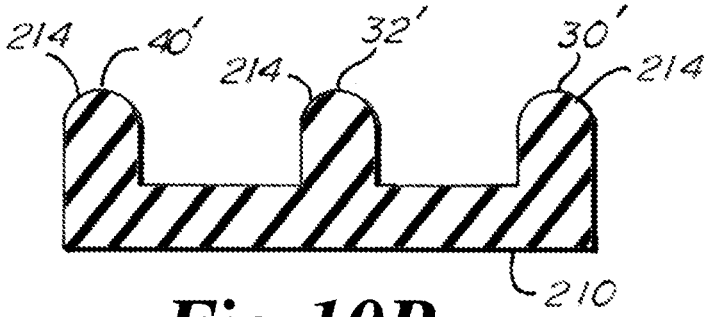
FIG. 10B shows a section view of another embodiment of the multiple seal arrangement where the bridge or connection between the multiple seals is a strip or base of adhesive, where the multiple seal is an endless triple seal.
Figure 10C:
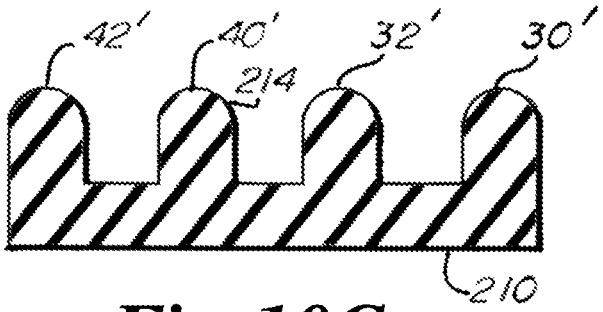
FIG. 10C shows a section view of another embodiment of the multiple seal arrangement where the bridge or connection between the multiple seals is a strip or base of adhesive, where the multiple seal is an endless quadruple seal.

FIGS. 10A, 10B and 10C show sections views of another embodiment of the endless multiple seal. FIGS. 10A, 10B and 10C show endless adhesive beads 30', 32', 40' and 42' that are interconnected by an endless adhesive bridge or endless adhesive connection 210. Beads 30', 32', 40' and 42' track the periphery of a face mask as do beads 30, 32, 40 and 42, except that the underface 212 of the bridge or connection 210 confronts the inside of the covering or filter 14 of the face mask. What confronts and digs into the face of the user of the face mask are the distal ends 214 of each of the beads or bead projections 30', 32', 40', and 42'. Distal ends 214 are preferably curved as beads 30, 32, 40 and 42 are curved. Endless bridge or endless connection 210 is integral with beads or bead projections 30', 32', 40' and 42'. It is believed that leaks are more likely to occur between the seal and the face rather than the seal and the mask, and it is believed that a digging into or a slight penetration of the relatively hard rubber or rubber like bead is more likely to offer protection than a wide flat expanse of adhesive where skin is involved. However, a wide flat expanse of adhesive may be utilized to seal the multiple seal arrangement to a face mask, such as face 212 being sealed to a face mask.

A PortaCount® Plus mode 8020 Respirator Fit Tester is a machine manufactured by TSI Inc. of Shoreview, Minn. This PortaCount® tester quantitatively measures whether a respirator is donned properly. This PortaCount® tester performs a quantitative respirator fit test.

A PortaCount® Plus mode 8020 Respirator Fit Tester and N95-Companion brochure available from TSI Inc. of Shoreview, Minn., provides in part the following:

The PORTACOUNT makes a direct measurement of respirator fit factors. There are no error-inducing assumptions made to calculate "equivalent" fit factors. The measurement is made while the person simultaneously performs dynamic moving and/or breathing exercises designed to stress the respirator seal in ways that simulate anticipated workplace motions.

The PORTACOUNT eliminates the human variables associated with qualitative methods. Variations in sensitivity to the challenge chemical or lack of cooperation can't influence the test results because the employee makes no decisions. And, unlike other methods, the PORTACOUNT results are immediate and unambiguous. The PORTACOUNT Plus performs the fit test and delivers a "pass" or "fail." It's that easy.

The PORTACOUNT has been accepted by OSHA for compliance with all fit testing regulations since 1988. Recent standards, including the new OSHA respiratory protection standard 29 CFR 1910.134, specifically recognize the PORTACOUNT and provide specific protocols.

The PORTACOUNT can be used to fit test almost any tight-fitting respirator including elastomeric half- and full-face masks, PAPRs, SCBA, and even disposable (filtering-facepiece) respirators. Positive-pressure masks must be temporarily converted to negative-pressure mode per regulatory requirements prior to fit testing. Series-95 disposable masks require use of the N95-Companion™ accessory.

The PORTACOUNT Plus eliminates the awkward fit test hoods and chemical exposure concerns associated with other fit test methods. It uses the microscopic particles that exist in ambient air to measure the fit factor directly. The PORTACOUNT measures the concentration of these particles around the person's head and then measures the concentration of those particles that leak into the respirator. The ratio of these two numbers is the fit factor. A fit factor of 100, for example, means that the air inside the respirator is 100 times cleaner than the air outside. The PORTACOUNT measures a fit factor for each of the fit test exercises and then computes an overall fit factor for the entire test, along with a pass or fail indication.

Advanced technology from TSI makes it possible for you to use the PORTACOUNT Plus to quantitatively fit test N95 disposable respirators. You no longer have to mess with the tedious and error-prone qualitative methods like saccharin, Bitrex, and irritant smoke. The N95-Companion works with the PORTACOUNT Plus to provide you with a complete solution to all of your fit testing needs. Use the PORTACOUNT alone for masks equipped with Series-99 and Series-100 filters. Simply add the N95-Companion to fit test masks with Series-95 filters, including the popular N95 filtering-facepiece disposables. When necessary, you can disconnect the N95-Companion in a matter of moments and use the PORTACOUNT Plus alone. The N95-Companion is simply an accessory for the PORTACOUNT Plus. The fit factor measurement is made by the PORTACOUNT. When the N95-Companion is attached, the PORTACOUNT uses only a small portion of the particles in the ambient air.

The N95-Companion contains an electrostatic particle classifier. The particle classifier takes advantage of electrostatic charges that exist on ambient particles to strip out a predetermined particle size range of interest, from the broad range of sizes present in ambient air. The resulting particles leave the N95-Companion and are transported via flexible tubing to the PORTACOUNT for counting. The PORTACOUNT, seeing only the particles of interest, then compares the number outside the mask to the number inside the mask. This ratio of particles counted is the fit factor. For a detailed explanation of the theory of operation, see TSI's application bulletin ITI-053.

This is the ultimate respirator fit test software . . . and its included with every PORTACOUNT Plus Respirator Fit Tester! FitPlus v3 Software has all the features you need to make accurate fit testing easy, automated and organized. The updated software prompts the respirator wearer through the required exercise protocol, records the results in a database, prints reports, and more.

Select the worker name, choose a respirator from the list, enter the mask size, and go! The computer takes over from that point on by controlling the PORTACOUNT fit tester and prompting the worker to perform the proper fit test exercises one by one. Since your undivided attention is no longer required, you're free to get the next person ready.

FitPlus software provides the vital documentation you need for your respirator program. You can provide management with hard-copy evidence that each employee passed a fit test, was trained to don the respirator properly and assigned a mask size that fits correctly. You can't get this from a qualitative fit test because the results are highly operator-dependent and subject to employee deception or misunderstanding.

Specifications

PORTACOUNT Plus Model 8020 Respirator Fit Tester

Fit Factor Range: 1 to greater than 10,000

Concentration Range: 0.01 to 5×105 particles/$cm^3$

Particle Size Range: 0.02 to greater than 1 micrometer

Typical Fit Factor Accuracy: ±10% of reading

Specifications

Model 8095 N95-Companion Accessory

Fit Factor Range: 1 to 200

Concentration Range: 0.01 to 5×105 particles/$cm^3$

Test Particle Size: 0.04 micrometer (nominal)

Typical Fit Factor Accuracy: ±10% of reading

Using the PORTACOUNT Plus Model 8020 Respirator Fit Tester, applicant utilized the following method for testing a double bead adhesive seal having no bridges, where the double bead adhesive seal had essentially the structure of the beads 30 and 32 of FIG. 1B, which method is described below, and the results of which are shown in Table 1 below.

The respirator used was a 3M 1860 N95 filtering facepiece respirator which is available in two sizes; small and regular. That respirator was selected because it has a very typical design with a pliable metal nose band that must be manually formed by the wearer to conform to the shape of the face and nose bridge. The fit test operator selected the size respirator that was likely to fit each test subject based on visual evaluation of face size and shape. The identical size respirator (with and without adhesive) was used for each pair of fit tests.

The adhesive used for the double bead (independent beads, spaced from each other) was a pressure sensitive hot melt adhesive available from The Glue Factory, An Ellsworth Adhesives Company, of Appleton, Wis.

The double bead (independent beads) of adhesive was applied from by a hot melt adhesive hand gun applicator, where the adhesive exits the hand gun applicator as a liquid and then cools to a rubber or rubbery like state. An automated process may be used to apply the adhesive to existing respirators. The adhesive application may or may not be an "after market" adhesive that may be easily applied by respirator users.

The adhesive is a clear non-toxic material with very high adhesion to human skin. The adhesive remains tacky after a few donnings, indicating that the respirator could be used more than once, however this study did not evaluate reusability. All fit tests done on adhesive equipped respirators were first time donnings.

The high adhesion was most obvious when the respirator was doffed. However, there was never any evidence of adhesive residue left on the skin after a respirator was removed.

There were 7 male and 4 female test subjects. Workers with beards were not allowed to participate. However, there was no attempt to eliminate those who had facial stubble, were cigarette smokers, or had previous respirator experience. Test subjects were accepted as is.

Test subject training was minimal, consisting of a verbal explanation of the respirator manufacturer's recommended donning method immediately prior to the fit test. Since the study was not concerned with test subject donning skills, the fit test operator assisted when necessary to make sure the respirator straps were properly positioned. Most test subjects had never worn a respirator before.

Test subjects were directed to perform a positive and negative user seal check in an attempt to make sure the respirator was well seated. Adjustments to the nose band were made as needed. Once the test subject indicated that face seal leakage could not be detected, the fit test began immediately.

The OSHA 8-exercise quantitative fit test protocol (29 CFR 1910.134) was used for all fit tests:

NB: Normal breathing (60 sec)

DB: Deep Breathing (60 sec)

SS: Head Side to Side (60 sec)

UD: Head up & down (60 sec)

T: Talking out loud (60 sec)

G: Grimace (15 sec, no measurement)

B: Bending (60 sec)

NB: Normal breathing (60 sec)

Measurements were taken using a PortaCount® Plus model 8020 Respirator Fit Tester (available from TSI Inc, Shoreview, Minn.) without the use of the N95-Companion™ accessory normally used with N95 respirators. The N95-Companion was not used because it limits the measurable fit factor to a value of 200, which would have biased the fit factor data. Fit factors above 200 were likely to occur; the filtration efficiency of the 3M 1860 respirator easily exceeds the 95% NIOSH minimum under the conditions present during typical fit testing with ambient aerosol.

Notwithstanding the 200 limit, not using the N95-Companion probably caused fit factors to be lower than they would have been if it were used, since the function of the N95Companion is to eliminate filter penetration and isolate face seal leakage. Thus, the fit factors reported in this study should be thought of as total inward leakage (TIL) measurements. It should also be noted that this testing does not include an analysis of pass vs. fail for the OSHA minimum fit factor of 100. The use of TIL measurements instead of classic fit factors invalidates the application of that pass/fail value. However, it should be noted that since TIL measurements include filter leakage as well as face seal leakage, any TIL measurement above 100 can safely be assumed to indicate a fit factor above 100. In other words, a test subject who achieves a TIL-based fit factor value above 100 would certainly have passed the fit test with an even higher value if a classic fit factor (face seal only) measurement had been made.

Another change was made due to the absence of the N95-Companion which employs a device called the sampling pendant that hangs around the test subject's neck and supports the weight of the 1.5-foot twin sample tube. Unlike most elastomeric respirators, filtering facepiece respirators can be affected by the weight of the sample tube pulling down. When the N95-Companion is not used, the 5-foot PortaCount sample tube (pair of ⅛ inch ID×¼ in OD) represents a significant weight which could bias the measurements. For this study we used 5 feet of light weight tubing (pair of ⅛ inch ID×3/16 inch OD) tubing which is less than half the weight of the factory tubing. In addition, subjects were instructed to prevent the sample tube from pulling on the respirator during the bending exercise by holding onto it with one hand.

The respirators with adhesive yielded overall fit factors that were an average of 271 percent higher than overall fit factors without adhesive, as shown in Table 1 below.

All subjects except for subject 10 experienced a higher fit factor with adhesive. Subject 10 achieved an overall fit factor of 1170 without adhesive, which was the highest non-adhesive overall fit factor recorded during the study. Keeping in mind that the measurements are technically TIL rather than true fit factors (see previous discussion), a measurement that high on an N95 filtering facepiece indicates near zero face seal leakage. A perfect fit cannot be improved, as suggested by the trivial 3 percent drop in the overall fit factor with adhesive (1170 to 1130).

While the adhesive respirators showed improved overall fit factors in virtually all cases, individual exercise fit factors showed significant variation. It was observed that the exercises following the grimace maneuver were sometimes very low for the non-adhesive respirator. The purpose of the grimace exercise is to intentionally attempt to break the face seal in order to see if the respirator reseats afterwards. There is no measurement made during the 15-second grimace because what is important is the fit factor for the exercise following the grimace; bending. A high fit factor during bending indicates that the face seal either never broke during the grimace or it re-seated immediately. A low fit factor after the grimace indicates that the face seal was broken and failed to re-seat. Subjects 4 and 12 are cases where the non-adhesive respirator was fitting well until after the grimace. The adhesive respirator never exhibited face seal failure due to grimacing for any test subject. It was observed that breaking the aggressive adhesive seal with facial movement is unlikely because once the adhesive area is pressed against the skin the respirator cannot slide on the face. Movement of the face stresses the respirator fabric, but the adhesive seal remains intact.

Subject 4 was tested despite not being clean shaven. A 3 day stubble was obvious and could be the cause of the face seal being broken and not resealed.

Subject 12 had a large nose bridge and commented that he considered respirators generally useless for him because they always leaked. The first respirator tried was a regular and the wearer determined the nose bridge leakage was excessive and the test was terminated. The subject requested the other size (small) and determined the leakage was much less. The test was then completed and comparison made. In this case, we used the size that the wearer said felt like it sealed the best.

The aggressiveness of the adhesive requires a modified donning procedure. The wearer must carefully center the respirator in the proper position on the face on the first try because the adhesive does not permit adjusting the respirator by sliding it on the face. If the respirator is not properly centered on first contact, it can be removed for another attempt, as the adhesive remains tacky for several donnings. The re-use of adhesive respirators was not part of this study and all subjects were cautioned about initial centering of the respirator.

As the above method and results show, face seal adhesive can significantly improve the protection provided by an N95 filtering facepiece respirator.

Events that can degrade the face seal of a respirator such as extreme facial movement or inadvertently shifting the respirator due to physical activity are much less likely to happen with an adhesive seal because the respirator is prevented from moving in relation to the face.

TABLE 1

Comparison of Overall Fit Factors with and without adhesive double seal where most users had never worn a respirator

| Subject No. | Respirator with adhesive double seal (overall fit factor value) | Respirator with no adhesive seal (overall fit factor value) | Percent improvement due to adhesive double seal |
|---|---|---|---|
| 1 | 1120 | 676 | 66 |
| 9 | 619 | 181 | 242 |
| 3 | 1200 | 443 | 171 |
| 6 | 212 | 32 | 563 |
| 10 | 1130 | 1170 | −3 |
| 12 | 175 | 46 | 280 |
| 4 | 565 | 79 | 615 |
| 11 | 260 | 30 | 767 |
| 2 | 1000 | 691 | 45 |
| 5 | 1000 | 755 | 32 |
| 7 | 682 | 228 | 199 |
| | Average Percent Change | | 271 |
| | Correlation Factor | | 0.844 |

The apparatus and method used to generate the data of Table 1 was also utilized to generate the data of Table 2 and Table 3 below, except that the face mask tested employed a single bead, namely, bead 30 instead of bead 32 of FIG. 1B was employed, and except that the identity of the subjects was different.

TABLE 2

Comparison of Overall Fit Factors with and without adhesive single seal for experienced users

| Subject No. | Respirator with adhesive single seal (overall fit factor value) | Respirator with no adhesive seal (overall fit factor value) | Percent improvement due to adhesive single seal |
|---|---|---|---|
| 042 | 94 | 56 | 68 |
| 0283 | 84 | 173 | −51 |
| 392 | 129 | 95 | 36 |
| 00734 | 42 | 40 | 5 |
| 1234 | 69 | 34 | 103 |
| 2457 | 290 | 154 | 88 |
| 2636 | 349 | 196 | 78 |
| | Average Percent Change | | 47 |
| | Correlation Factor | | 0.75 |

TABLE 3

Comparison of Overall Fit Factors with and without adhesive single seal for inexperienced users

| Subject No. | Respirator with adhesive single seal (overall fit factor value) | Respirator with no adhesive seal (overall fit factor value) | Percent improvement due to adhesive single seal |
|---|---|---|---|
| 109 | 77 | 70 | 10 |
| 627 | 127 | 131 | −3 |
| 889 | 143 | 104 | 38 |
| 2429 | 43 | 181 | −76 |
| 02462 | 149 | 169 | −12 |
| | Average Percent Change | | −9 |
| | Correlation Factor | | −0.09 |

The multiple seal arrangements shown and described in this application, i.e., the double seals with and without bridges, triple seals with and without bridges, and quadruple seals with and without bridges, may be employed on a number of face masks or respirators. These face masks or respirators include 1) face masks or respirators for occupational use, 2) face masks or respirators for use by the general public, 3) disposable face masks or respirators, 4) woven or nonwoven face masks or respirators, 5) face masks with multiple layers such as a filter layer and a supporting layer, 6) half masks, 7) full masks, 8) air supplied respirators, 9) self-contained respirators, 10) active respirators, 11) filtering face piece respirators, 12) air purifying face masks or respirators, 13) particulate filter face masks or respirators, 14) gas filtering or blocking face masks or respirators, 15) electret face masks or respirators, 16) face masks or respirators designed to protect the wearer of the face mask or respirator, 17) face masks or respirators designed to protect a person or thing other than wearer of the face mask, such as surgical face masks.

The multiple seal arrangements shown and described in this application, i.e., the double seals with and without bridges, triple seals with and without bridges, and quadruple seals with and without bridges, may be employed on a number of face masks or respirators having a number of features, with the features including but not limited to the type of face mask, the shape of the face mask, the valve or valves on the face mask or respirator, the filter or covering of the face mask or respirator, the layer or layers or material or materials making up the filter or covering of the face mask or respirator, the chemical composition of the filter or covering of the face mask or respirator, and, as to such face masks and respirators and such features, the following U.S. Patents and U.S. Patent Application Publications are hereby incorporated by reference in their entireties into this application:

| First named inventor | U.S. Pat. No. or U.S. Patent Application Publication Number | Date of issue or date of publication | Title of U.S. Patent or U.S. Patent Application Publication |
|---|---|---|---|
| Krueger et al. | 4,729,371 | Mar. 8, 1988 | Respirator Comprised Of Blown Bicomponent Fibers |
| Dyrud et al. | 4,807,619 | Feb. 28, 1989 | Resilient Shape-Retaining Fibrous Filtration Face Mask |
| Skov | 4,850,347 | Jul. 25, 1989 | Face Mask |
| Kronzer et al. | 5,307,796 | May 3, 1994 | Methods of Forming Fibrous Filtration Face Masks |
| Burgio | 5,374,458 | Dec. 20, 1994 | Molded, Multiple-Layer Face Mask |
| Byram | 6,119,692 | Sep. 19, 2000 | Convenient "Drop-Down" Respirator |
| Landgrebe et al. | 6,420,455 B1 | Jul. 16, 2002 | Antimicrobial Composition Containing Photosensitizers Articles, And Methods Of Use |
| Castiglione | 6,705,317 B2 | Mar. 16, 2004 | Retention Assembly With Compression Element And Method Of Use |
| Angadjivand et al. | 6,783,574 B1 | Aug. 31, 2004 | Electret Filter Media And Filtering Masks That Contain Electret Filter Media |
| Springett et al. | 6,827,764 B2 | Dec. 7, 2004 | Molded Filter Element That Contains Thermally Bonded Staple Fibers And Electrically-Charged Microfibers |
| Perez et al. | 6,849,329 B2 | Feb. 1, 2005 | Charged Microfibers, Microfibrillated Articles And Use Thereof |
| Kronzer et al. | 7,131,442 B1 | Nov. 7, 2006 | Fibrous Filtration Face Mask |
| Brey et al. | 7,309,513 B2 | Dec. 18, 2007 | Broad Spectrum Filter System Including Tungsten-Based Impregnant And Being Useful For Filtering Contaminants From Air Or Other Gases |

-continued

| First named inventor | U.S. Pat. No. or U.S. Patent Application Publication Number | Date of issue or date of publication | Title of U.S. Patent or U.S. Patent Application Publication |
|---|---|---|---|
| Martin | 7,503,326 B2 | Mar. 17, 2009 | Filtering Face Mask With A Unidirectional Valve Having A Stiff Unbiased Flexible Flap |
| Leir et al. | 7,390,351 B2 | Jun. 24, 2008 | Electrets And Compounds Useful In Electrets |
| Betz et al. | 7,594,510 B2 | Sep. 29, 2009 | Respiratory Protection Device |
| Japuntich et al. | US 2002/0023651 A1 | Feb. 28, 2002 | Face Mask That Has A Filtered Exhalation Valve |
| Baumann et al. | US 2002/0046754 A1 | Apr. 25, 2002 | Anti-Fog Face Mask |
| Brostrom et al. | US 2002/0088466 A1 | Jul. 11, 2002 | Drop-Down Face Mask Assembly |
| Japuntich et al. | US 2003/0005934 A1 | Jan. 9, 2003 | Face Mask That Has A Filtered Exhalation Valve |
| Bostock et al. | US 2003/0192546 A1 | Oct. 16, 2003 | Flat-Folded Personal Respiratory Protection Devices And Processes For Preparing Same |
| Angadjivand et al. | US 2004/0011362 A1 | Jan. 22, 2004 | Crush Resistant Filtering Face Mask |
| Martin et al. | US 2004/0255947 A1 | Dec. 23, 2004 | Filtering Face Mask That Has A Resilient Seal Surface In Its Exhalation Valve |
| Mittelstadt et al. | US 2005/0139216 A1 | Jun. 30, 2005 | Unidirectional Respirator Valve |
| Bostock et al. | US 2006/0180152 A1 | Aug. 17, 2006 | Flat-Folded Personal Respiratory Protection Devices And Processes For Preparing Same |
| Japuntich et al. | US 2007/0119459 A1 | May 31, 2007 | Method Of Making A Filtering Face Mask Having New Exhalation Valve |
| Betz | US 2007/0235031 A1 | Oct. 11, 2007 | Full Face Respiratory Protection Device |
| Kalatoor | US 2008/0023006 A1 | Jan. 31, 2008 | Respirator That Uses A Predefined Curved Nose Foam |
| Gebrewold et al. | US 2008/0099022 A1 | May 1, 2008 | Respirator That Uses A Predefined Nose Foam Shape |
| Angadjivand et al. | US 2008/0315454 A1 | Dec. 25, 2008 | Method Of Making Meltblown Fiber Web With Staple Fibers |
| Angadjivand et al. | US 2008/0318014 A1 | Dec. 25, 2008 | Molded Respirator Comprising Meltblown Fiber Web With Staple Fibers |
| Lee et al. | US 2009/0000624 A1 | Jan. 1, 2009 | Respirator Having A Harness And Methods Of Making And Fitting The Same |
| Martin et al. | US 2009/0078261 A1 | Mar. 26, 2009 | Filtering Face-Piece Respirator That Has Expandable Mask Body |
| Gebrewold et al. | US 2009/0078262 A1 | Mar. 26, 2009 | Filtering Face-Piece Respirator Support Structure That Has Living Hinges |
| Martin et al. | US 2009/0078264 A1 | Mar. 26, 2009 | Filtering Face-Piece Respirator Having A Frame For Supporting The Exhalation Valve |
| Gebrewold et al. | US 2009/0078265 A1 | Mar. 26, 2009 | Respirator Having Dynamic Support Structure And Pleated Filtering Structure |
| Stepan et al. | US 2009/0078266 A1 | Mar. 26, 2009 | Filtering Face-Piece Respirator Having Buckles Integral To The Mask Body Support Structure |
| Daugaard et al. | US 2009/0090364 A1 | Apr. 9, 2009 | Filtering Face-Piece Respirator Having Nose Clip Molded Into The Mask Body |

-continued

| First named inventor | U.S. Pat. No. or U.S. Patent Application Publication Number | Date of issue or date of publication | Title of U.S. Patent or U.S. Patent Application Publication |
|---|---|---|---|
| Martin et al. | US 2009/0133700 A1 | May 28, 2009 | Face Mask With Unidirectional Valve |
| Martin | US 2009/0235934 A1 | Sep. 24, 2009 | Filtering Face-Piece Respirator Having An Integrally-Joined Exhalation Valve |

As shown in FIG. 5A, the inside of the covering 14 includes a single and common face and the endless seals 30, 32 engage this single and common face.

The first endless skin adhesive seal 30 is between the periphery 16 of the covering 14 and the second endless skin adhesive seal 32. The second endless skin adhesive seal 32 includes an inner edge. The covering 14 extends in an inward direction from the inner edge of the second endless skin adhesive seal 32. The inward direction is a direction away from the first endless skin adhesive seal 30. The second endless skin adhesive seal 32 includes a first diametric portion and a second diametric portion. The first and second diametric portions extend diametrically across from each other. The single and common face of the inside 18 of the covering 14 extends diametrically between the first and second diametric portions. The second endless skin adhesive seal 32 includes an inner and outer edge. The inner edge of the second endless skin adhesive seal 32 defines an inner area. The single and common face extending a) inwardly from the inner edge of the second endless skin adhesive seal 32, b) into the inner area, and c) to an opposing portion of the second endless skin adhesive seal 32.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A multiple seal arrangement for a periphery of a respirator, comprising:

a) a first endless skin adhesive seal;

b) a second endless skin adhesive seal, the second endless skin adhesive seal being spaced from the first endless skin adhesive seal, and the second endless skin adhesive seal confronting the first endless adhesive seal; and c) an endless bridge connection joining the first and second endless skin adhesive seals, the first and second endless skin adhesive seals projecting from the endless bridge connection, the endless bridge connection having an underface on the respirator, each of the first and second endless skin adhesive seals having a distal end, said distal end of said first and second endless skin adhesive seals confronting a face of a user, said distal ends of said first and second endless skin adhesive seals being spaced apart from each other.

* * * * *